US008896197B2

(12) United States Patent
Negley et al.

(10) Patent No.: US 8,896,197 B2
(45) Date of Patent: Nov. 25, 2014

(54) LIGHTING DEVICE AND METHOD OF MAKING

(75) Inventors: Gerald H. Negley, Durham, NC (US); Antony Paul Van De Ven, Hong Kong (CN)

(73) Assignee: Cree, Inc., Durham, NC (US)

( * ) Notice: Subject to any disclaimer, the term of this patent is extended or adjusted under 35 U.S.C. 154(b) by 598 days.

(21) Appl. No.: 13/104,469

(22) Filed: May 10, 2011

(65) Prior Publication Data

US 2011/0279015 A1 Nov. 17, 2011

Related U.S. Application Data

(60) Provisional application No. 61/334,390, filed on May 13, 2010.

(51) Int. Cl.

| | |
|---|---|
| ***H01J 1/62*** | (2006.01) |
| ***H05B 33/08*** | (2006.01) |
| ***F21K 99/00*** | (2010.01) |
| *F21V 29/00* | (2006.01) |
| *F21Y 101/02* | (2006.01) |
| *F21Y 113/00* | (2006.01) |

(52) U.S. Cl.

CPC ..... *F21K 9/137* (2013.01); *F21V 29/2206* (2013.01); *F21Y 2101/02* (2013.01); *H05B 33/0857* (2013.01); *H05B 33/086* (2013.01); *F21Y 2113/005* (2013.01)

USPC ..... 313/501; 313/502; 362/231; 362/230

(58) Field of Classification Search

CPC ..... F21K 9/137; H05B 33/086

USPC ..... 313/501–502; 362/231, 230

See application file for complete search history.

(56) References Cited

U.S. PATENT DOCUMENTS 5,384,519 A 1/1995 Gotoh
5,803,579 A 9/1998 Turnbull et al.

(Continued)

FOREIGN PATENT DOCUMENTS

EP 1 160 883 12/2001
JP 10-163535 6/1998

(Continued)

OTHER PUBLICATIONS

Van de Ven et al., "Warm White Illumination with High CRI and High Efficacy by Combining 455 nm Excited Yellowish Phosphor LEDs and Red AlInGaP LEDs", First International Conference on White LEDs and Solid State Lighting, Nov. 30, 2007.

(Continued)

*Primary Examiner* — Elmito Breval
(74) *Attorney, Agent, or Firm* — Burr & Brown, PLLC

(57) ABSTRACT

A lighting device comprising first and second groups of non-white light sources emitting light outside a first area on a 1976 CIE Chromaticity Diagram bounded by a curves 0.01 u'v' above and below the blackbody locus and within a second area enclosed by saturated light curves from 430 to 465 nm and from 560 to 580 nm and segments from 465 to 560 nm and from 580 to 430 nm and a supplemental light emitter in the range of 600 to 640 nm. Also, a lighting device, comprising a first string of non-white phosphor converted light sources with excitation sources having dominant wavelengths that differ by at least 5 nm, a second string of non-white light sources, and a third string of supplemental light emitters in the range of 600 to 640 nm.

23 Claims, 4 Drawing Sheets

(56) References Cited

U.S. PATENT DOCUMENTS

| | | | |
|---|---|---|---|
| 6,132,072 | A | 10/2000 | Turnbull et al. |
| 6,153,971 | A | 11/2000 | Shimizu et al. |
| 6,212,213 | B1 | 4/2001 | Weber et al. |
| 6,234,648 | B1 | 5/2001 | Borner et al. |
| 6,513,949 | B1 | 2/2003 | Marshall et al. |
| 6,538,371 | B1 | 3/2003 | Duggal et al. |
| 6,550,949 | B1 | 4/2003 | Bauer et al. |
| 6,552,495 | B1 | 4/2003 | Chang |
| 6,577,073 | B2 | 6/2003 | Shimizu et al. |
| 6,692,136 | B2 | 2/2004 | Marshall et al. |
| 6,734,465 | B1 | 5/2004 | Taskar et al. |
| 6,784,463 | B2 | 8/2004 | Camras et al. |
| 6,817,735 | B2 | 11/2004 | Shimizu et al. |
| 6,841,804 | B1 | 1/2005 | Chen et al. |
| 6,914,267 | B2 | 7/2005 | Fukasawa et al. |
| 6,936,857 | B2 | 8/2005 | Doxsee et al. |
| 7,005,679 | B2 | 2/2006 | Tarsa et al. |
| 7,008,078 | B2 | 3/2006 | Shimizu et al. |
| 7,014,336 | B1 | 3/2006 | Ducharme et al. |
| 7,061,454 | B2 | 6/2006 | Sasuga et al. |
| 7,066,623 | B2 | 6/2006 | Lee et al. |
| 7,095,056 | B2 | 8/2006 | Vitta |
| 7,144,121 | B2 | 12/2006 | Minano et al. |
| 7,213,940 | B1 | 5/2007 | Van De Ven et al. |
| 7,354,172 | B2 | 4/2008 | Chemel et al. |
| 7,358,954 | B2 | 4/2008 | Negley |
| 7,365,485 | B2 | 4/2008 | Fukasawa et al. |
| 7,614,759 | B2 | 11/2009 | Negley |
| 7,642,708 | B2 | 1/2010 | Juestel et al. |
| 7,718,991 | B2 | 5/2010 | Negley |
| 7,722,220 | B2 | 5/2010 | Van de Ven |
| 7,744,243 | B2 | 6/2010 | Van de Ven |
| 7,768,192 | B2 | 8/2010 | Van De Ven et al. |
| 8,029,155 | B2 | 10/2011 | Van de Ven et al. |
| 2002/0070681 | A1 | 6/2002 | Shimizu et al. |
| 2003/0030063 | A1 | 2/2003 | Sosniak et al. |
| 2003/0067773 | A1 | 4/2003 | Marshall et al. |
| 2003/0146411 | A1 | 8/2003 | Srivastava et al. |
| 2004/0105261 | A1 | 6/2004 | Ducharme et al. |
| 2004/0179366 | A1 | 9/2004 | Takeda et al. |
| 2004/0217364 | A1 | 11/2004 | Tarsa et al. |
| 2005/0082974 | A1 | 4/2005 | Fukasawa et al. |
| 2005/0093442 | A1 | 5/2005 | Setlur et al. |
| 2006/0012989 | A1 | 1/2006 | Lee et al. |
| 2006/0105482 | A1 | 5/2006 | Alferink et al. |
| 2006/0180818 | A1 | 8/2006 | Nagai et al. |
| 2006/0285325 | A1 | 12/2006 | Ducharme et al. |
| 2007/0001188 | A1 | 1/2007 | Lee |
| 2007/0278934 | A1 | 12/2007 | Van de Ven |
| 2008/0130285 | A1 | 6/2008 | Negley |
| 2008/0304260 | A1* | 12/2008 | Van De Ven et al. ..... 362/231 |
| 2009/0026913 | A1 | 1/2009 | Mrakovich |
| 2009/0184616 | A1 | 7/2009 | Van De Ven et al. |
| 2009/0296384 | A1 | 12/2009 | Van de Ven |
| 2009/0323321 | A1 | 12/2009 | Paolini |
| 2010/0026191 | A1 | 2/2010 | Radermacher et al. |
| 2010/0254130 | A1 | 10/2010 | Van de Ven |
| 2011/0215725 | A1 | 9/2011 | Paolini |
| 2011/0310602 | A1 | 12/2011 | Van de Ven |

FOREIGN PATENT DOCUMENTS

| | | |
|---|---|---|
| JP | 2002-057376 | 2/2002 |
| JP | 2003-515956 | 5/2003 |
| JP | 2003-529889 | 10/2003 |
| JP | 2004-080046 | 3/2004 |
| JP | 2004-103443 | 4/2004 |
| JP | 2004-356116 | 12/2004 |
| JP | 2005-513724 | 5/2005 |
| JP | 2005-142311 | 6/2005 |
| WO | 03/053111 | 6/2003 |
| WO | 2005/013365 | 2/2005 |
| WO | 2005/124877 | 12/2005 |
| WO | 2006/028312 | 3/2006 |
| WO | 2008/035245 | 3/2008 |
| WO | 2008/041153 | 4/2008 |
| WO | 2008/139369 | 11/2008 |
| WO | 2009/015327 | 1/2009 |
| WO | 2009/049019 | 4/2009 |
| WO | 2009/158514 | 12/2009 |

OTHER PUBLICATIONS

Cree® XLamp® 7090 XR-E Series LED Binning and Labeling, 2006.

* cited by examiner

LIGHTING DEVICE AND METHOD OF MAKING

CROSS-REFERENCE TO RELATED APPLICATIONS

This application is related to U.S. patent application Ser. No. 12/720,387, filed Mar. 9, 2010 (now U.S. Patent Publication No. 2011-0221330), entitled "HIGH CRI LIGHTING DEVICE WITH ADDED LONG-WAVELENGTH BLUE COLOR" , the entirety of which is incorporated herein by reference.

This application claims the benefit of U.S. Provisional Patent Application No. 61/334,390, filed May 13, 2010, the entirety of which is incorporated herein by reference as if set forth in its entirety.

FIELD OF THE INVENTIVE SUBJECT MATTER

The present inventive subject matter relates to lighting devices and methods of making them. In some embodiments, the present inventive subject matter relates to a lighting device which includes at least two non-white light sources and at least one supplemental light emitter which improve the CRI Ra of the light emitted from the lighting device. In addition, some embodiments of the present inventive subject matter provide lighting devices which respectively emit light of high CRI Ra in a wide range of color temperatures.

BACKGROUND

General illumination devices are typically rated in terms of their color reproduction. Color reproduction is typically measured using the Color Rendering Index (CRI Ra). CRI Ra is a modified average of the relative measurements of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator.

Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra). See Commission Internationale de l'Eclairage. Method of Measuring and Specifying Colour Rendering Properties of Light Sources, CIE 13.3 (1995) for further information on CRI.

The color of visible light output by a light emitter, and/or the color of blended visible light output by a plurality of light emitters can be represented on either the 1931 CIE (Commission International de I'Eclairage) Chromaticity Diagram or the 1976 CIE, Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). Each point (i.e., each "color point") on the respective Diagrams corresponds to a particular hue. For a technical description of CIE chromaticity diagrams, see, for example, "Encyclopedia of Physical Science and Technology", vol. 7, 230-231 (Robert A Meyers ed., 1987). The spectral colors are distributed around the boundary of the outlined space, which includes all of the hues perceived by the human eye. The boundary represents maximum saturation for the spectral colors.

The 1931 CIE Chromaticity Diagram can be used to define colors as weighted sums of different hues. The 1976 CIE Chromaticity Diagram is similar to the 1931 Diagram, except that similar distances on the 1976 Diagram represent similar perceived differences in color.

In the 1931 Diagram, deviation from a point on the Diagram (i.e., "color point" or hue) can be expressed either in terms of the x, y coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues that would each be perceived as differing from the specified hue to a common extent (and likewise for loci of points defined as being spaced from a particular hue by other quantities of MacAdam ellipses). A typical human eye is able to differentiate between hues that are spaced from each other by more than seven MacAdam ellipses (but is not able to differentiate between hues that are spaced from each other by seven or fewer MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$. This formula gives a value, in the scale of the u' v' coordinates, corresponding to the distance between points. The hues defined by a locus of points that are each a common distance from a specified color point consist of hues that would each be perceived as differing from the specified hue to a common extent.

A series of points that is commonly represented on the CIE Diagrams is referred to as the blackbody locus. The chromaticity coordinates (i.e., color points) that lie along the blackbody locus obey Planck's equation: $E(\lambda)=A\lambda^{-5}/(e^{(B/T)}-1)$, where E is the emission intensity, $\lambda$ is the emission wavelength, T is the color temperature of the blackbody and A and B are constants. The 1976 CIE; Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants that produce light that is on or near the blackbody locus can thus be described in terms of their color temperature.

Light emitting diode lamps have been demonstrated to be able to produce white light with component efficacy>150 L/W and are anticipated to be the predominant lighting devices within the next decade. See e.g., Narukawa, Narita, Sakamoto, Deguchi, Yamada, Mukai: "Ultra-High Efficiency White Light Emitting Diodes" Jpn. J. Appl. Phys. 32 (1993) L9 Vol. 45, No. 41, 2006, pp. L1084-L10-86; and on the World Wide Web nichia.com/about_nichia/2006/2006_122001.html.

Many systems are based primarily on LEDs which combine blue emitters+YAG:Ce or BOSE phosphors or Red, Green and Blue InGaN/AlInGaP LEDs; or UV LED excited RGB phosphors. These methods have good efficacy but only medium CRI or very good CRI and low efficacy. The efficacy and CRI tradeoff in LEDs is also an issue in the lighting industry with regard to fluorescent illumination. See Zukauskas A., Shur M. S., Cacka R. "Introduction to Solid-State Lighting" 2002, ISBN 0-471-215574-0, section 6.1.1 page 118.

CRI Ra is the most commonly used metric for measuring color quality today. This CIE standard method (see, e.g., Commission Internationale de l'Eclairage, Method of Measuring and Specifying Colour Rendering Properties of Light Sources, CIE 13.3 (1995)) compares the rendered colors of 8 reference color swatches illuminated by the test illumination to the rendered color of the same swatches illuminated by reference light. Illumination with a CRI Ra of less than 50 is very poor and only used in applications where there is no alternative for economic issues. Lights with a CRI Ra between 70 and 80 have application for general illumination where the colors of objects are not important. For some general interior illumination, a CRI Ra of at least 80 is acceptable.

The whiteness of the emission from a lighting device is somewhat subjective. In terms of illumination, it is generally defined as to its proximity to the planckian blackbody locus ("BBL"). Schubert, in his book Light-Emitting Diodes, second edition, on page 325 states, "the pleasantness and quality of white illumination decreases rapidly if the chromaticity point of the illumination source deviates from the planckian locus by a distance of greater than 0.01 in the x,y chromaticity system. This corresponds to the distance of about 4 MacAdam ellipses, a standard employed by the lighting industry. See Duggal A. R. "Organic electroluminescent devices for solid-state lighting" in Organic Electroluminescence edited by Z. H. Kafafi (Taylor and Francis Group, Boca Raton, Fla., 2005). Note the 0.01-rule-of-thumb is a necessary but not a sufficient condition for high quality illumination sources." A lighting device which has color coordinates that are within 4 MacAdam step ellipses of the planckian locus and which has a CRI Ra>80 is generally acceptable as a white light for illumination purposes. A lighting device which has color coordinates within 7 MacAdam ellipses of the planckian locus and which has a CRI Ra>70 is used as the minimum standard for many other white lighting devices including CFL and SSL (solid state lighting) lighting devices. (see DOE-Energy Star Program requirements for SSL Luminaires, 2006). A light with color coordinates within 4 MacAdam step ellipses of the planckian locus and a CRI Ra>85 is more suitable for general illumination purposes. CRI Ra>90 is preferable and provides greater color quality.

Some of the most commonly used LEDs in solid state lighting are phosphor excited LEDs. In many instances, a yellow phosphor (typically YAG:Ce or BOSE) is coated on a blue InGaN LED die. The resultant mix of yellow phosphor emitted light and some leaking blue light combines to produce a white light. This method typically produces light>5000K CCT and typically has a CRI Ra of between ~70 and 80. For warm white colors, an orange phosphor or a mix of red and yellow phosphor can be used.

Light made from combinations of standard "pure colors," red, green and blue, exhibit poor efficacy due primarily to the poor quantum efficiency of green LEDs. R+G+B lights also suffer from lower CRI Ra, in part due to the narrow full width at half maximum (FWHM) values of the green and red LEDs. Pure color LEDs (i.e., saturated LEDs) usually have a FWHM value in the range of from about 15 nm to about 30 nm.

UV based LEDs combined with red, green and blue phosphors offer quite good CRI Ra, similar to fluorescent lighting. Due to increased Stokes losses, however, they also have lower efficacies.

The highest efficiency LEDs today are blue LEDs made from InGaN. Commercially available devices have external quantum efficiency (EQE) as great as 60%. The highest efficiency phosphors suitable for LEDs today are YAG:Ce and BOSE phosphor with a peak emission around 555 nm. YAG:Ce has a quantum efficiency of >90% and is an extremely robust and well tested phosphor. Using this approach, almost any color along the tie line between the hue of the LED and the hue of the phosphor (e.g., FIG. 1 shows a tie line between a blue LED (i.e., an LED that emits blue light) that has a peak wavelength of about 455 nm and a yellow phosphor that has a dominant wavelength of about 569 nm).

In many lighting devices, the portion of the lumens of blue light is greater than approximately 3% and less than approximately 7%, and the combined emitted light appears white and falls within the generally acceptable color boundaries of light suitable for illumination. Efficacy as high as 150 L/W has been reported for LEDs made in this area, but commercially available lamps generally have CRI Ra in the range of from 70 to 80.

White LED lamps made with this method typically have a CRI Ra of between 70 and 80, the primary omission from the spectrum being red color components and, to some extent, cyan.

Red AlInGaP LEDs have very high internal quantum efficiency, but due to the large refractive index mismatch between AlInGaP and suitable encapsulant materials, a lot of light is lost due to total internal reflection (TIR). Regardless, red and orange packaged LEDs are commercially available with efficacies higher than 60 L/W.

Additional information on LEDs for general illumination, shortcomings and potential solutions may be found in "Light Emitting Diodes (LEDs) for General Illumination" OIDA, edited by Tsao J. Y, Sandia National Laboratories, 2002.

U.S. Pat. No. 7,095,056 (Vitta '056) discloses a white light emitting device and method that generate light by combining light produced by a white light source (i.e., light which is perceived as white) with light produced by at least one supplemental light emitting diode (LED). In one aspect, Vitta '056 provides a device which comprises a light source which emits light which would be perceived as white, a first supplemental light emitting diode (LED) that produces cyan light, and a second supplemental LED that produces red light, wherein the light emitted from the device comprises a combination of the light produced by the white light source, the first supplemental LED, and the second supplemental LED. While the arrangement disclosed in Vitta '056 allows the CCT to be changed, the CRI and the usefulness of the device reduces significantly at lower color temperatures, making this arrangement generally undesirable for indoor general illumination.

One technique for providing high efficiency and high color rendering is described in U.S. Pat. No. 7,213,940. The '940 patent describes combining non-white light with red/red-orange light to provide high color rendering and high efficiency. The teachings of the '940 patent are implemented in the TrueWhite technology incorporated in the LR6 6" recessed downlight, and the LR24 2'×2' architectural lay-in fixture from Cree, Inc. of Durham, N.C. The LR6 and the LR24 use phosphor converted LEDs that provide a blue LED and a YAG phosphor to provide blue-shifted-yellow ("BSY") light that is combined with light from red LEDs to provide white light with a CCT of 2700K or 3500K and a CRI of greater than 90.

FIG. 2 illustrates how a non-saturated non-white phosphor converted LED and a red/orange LED can be combined to provide white light.

The expression "phosphor converted" is used herein to mean a light emitter that includes an excitation emitter (e.g., a light emitting diode) and at least one phosphor, in which the excitation emitter generates light of a first wavelength, at least a portion of which is absorbed by the phosphor and re-emitted by the phosphor (in at least one different wavelength, typically in a range of wavelengths), whereby light of the first wavelength mixes with light re-emitted by the phosphor.

FIG. 3 is a schematic diagram of the LR6 and LR24 fixtures. As seen in FIG. 3, the LR6 and LR24 each have three strings of LEDs. Two of the strings include BSY LEDs and a third string includes red LEDs. The BSY LEDs are selected from two or more bins to provide a combined color point that is approximately opposite the BBL from the dominant wavelength of the red LEDs. The current through the red LEDs is then adjusted to pull the color point of the BSY LEDs to the BBL. Details on the operation of the LR6 and LR24 are found in:

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. Pat. No. 7,213,940 , issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" , the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009-0296384), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. patent application Ser. No. 12/248,220, filed on Oct. 9, 2008 (now U.S. Patent Publication No. 2009/0184616), the entirety of which is hereby incorporated by reference as if set forth in its entirety;

U.S. patent application Ser. No. 11/947,392, filed on Nov. 29, 2007 (now U.S. Patent Publication No. 2008/0130298), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/257,804, filed on Oct. 24, 2008 (now U.S. Patent Publication No. 2009/0160363), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety; and U.S. patent application Ser. No. 12/328,115, filed on Dec. 4, 2008 (now U.S. Patent Publication No. 2009-0184662), the entirety of which is hereby incorporated by reference as if set forth in its entirety.

The LR6 and LR24 each provide a CRI of greater than 90. Phosphor converted BSY LEDs with increased brightness have become available, the wavelength of the underlying excitation blue LED of these brighter BSY LEDs being lower. With this decrease in blue LED wavelength, it may become more difficult to achieve the desired high CRI. To overcome this issue, the LR6-230V has been fabricated to include a longer wavelength supplemental blue LED that replaces one of the BSY LEDs as shown in FIG. 3 and as described in U.S. patent application Ser. No. 12/248,220, filed on Oct. 9, 2008 (now U.S. Patent Publication No. 2009/0184616), the entirety of which is hereby incorporated by reference as if set forth in its entirety. A schematic diagram of the LR6-230V is provided as FIG. 4.

BRIEF SUMMARY OF THE INVENTIVE SUBJECT MATTER

By replacing a BSY LED with a blue LED, a device is provided in which the same current that is provided in the BSY LEDs also passes through the longer wavelength blue LED. The blue LED can be brightness matched to the string current through the BSY LED to provide the correct amount of supplemental longer wavelength blue light to increase the CRI, but not so much as to move the color point outside the control range of the BSY and red string current controllers. This brightness matching results in very dim blue LEDs being needed to replace a BSY LED. As blue LED performance continues to increase, the ability to obtain dim blue LEDs is reduced.

An alternative to adding the longer wavelength blue LED into the BSY string is to provide separate control for the supplemental longer wavelength blue LED. This would require a separate current control for the supplemental blue LED which would increase the complexity of the LED driver circuit and increase the cost of the fixture.

Even if the design constraints of using a supplemental longer wavelength blue LED could be overcome, in some fixtures the inclusion of a blue LED may still create some adverse effects. For example, in the LR24, there are 60 BSY LEDs spread across an approximately 64 square inch LED MCPCB. The light from the BSY LEDs is mixed and diffused before passing out of the fixture in a mixing chamber and diffuser lens system. Even with the mixing and diffusion of the LR24, replacing a few of the BSY LEDs with blue LEDs can lead to blue spots appearing in the diffuser that correspond to the locations of the blue LEDs. Thus, in some instances, replacing BSY LEDs with blue LEDs may not be an acceptable solution to improve the CRI of the LR24 or overcome changes in BSY excitation wavelength.

The present inventive subject matter can provide high CRI by providing at least two phosphor converted LEDs with at least two different wavelength blue excitation sources. In some embodiments, the two different phosphor converted LEDs may be combined with red/orange solid state emitters to provide white light. The phosphor converted LEDs may, in some embodiments, be BSY LEDs. In other embodiments, the phosphor converted LEDs may comprise at least one BSY LED and at least one BSR LED. In other embodiments, the phosphor converted LEDs may comprise at least one BSY LED, at least one BSG LED and at least one BSR LED. In still other embodiments, the phosphor converted LEDs may comprise at least one BSY LED and at least one BSR LED. In particular embodiments, the phosphor converted LEDs with different wavelength blue excitation sources may be provided in a same string.

The expression "BSY LED", as used herein, means an LED that emits BSY light.

The expression "BSR LED", as used herein, means an LED that emits BSR light.

The expression "BSG LED", as used herein, means an LED that emits BSG light.

The expression "BSY light", as used herein, means light having x, y color coordinates which define a point which is within (1) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38, and/or (2) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.29, 0.36, the second point having x, y coordinates of 0.32, 0.35, the third point having x, y coordinates of 0.41, 0.43, the fourth point having x, y coordinates of 0.44, 0.49, and the fifth point having x, y coordinates of 0.38, 0.53

The expression "BSR light", as used herein, means light having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.57, 0.35, the second point having x, y coordinates of 0.62, 0.32, the third point having x, y coordinates of 0.37, 0.16, and the fourth point having x, y coordinates of 0.40, 0.23.

The expression "BSG light", as used herein, means light having x, y color coordinates which define a point which is within (1) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.35, 0.48, the second point having x, y coordinates of 0.26, 0.50, the third point having x, y coordinates of 0.13, 0.26, the fourth point having x, y coordinates of 0.15, 0.20, and the fifth point having x, y coordinates of 0.26, 0.28, and/or (2) an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.21, 0.28, the second point having x, y coordinates of 0.26, 0.28, the third point having x, y coordinates of 0.32, 0.42, and the fourth point having x, y coordinates of 0.28, 0.44, and/or (3) an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.30, 0.49, the second point having x, y coordinates of 0.35, 0.48, the third point having x, y coordinates of 0.32, 0.42, and the fourth point having x, y coordinates of 0.28, 0.44.

In accordance with a first aspect of the present inventive subject matter, there is provided a lighting device comprising:

a first group of non-white light sources, the non-white light sources, when illuminated, emitting light having u', v' color coordinates which define a point which is (1) outside a first area on a 1976 CIE Chromaticity Diagram which is bounded by a first white-light boundary curve which is 0.01 u'v' above the planckian blackbody locus and a second white-light boundary curve which is 0.01 u'v' below the planckian blackbody locus, and line segments connecting respective left and right ends of the first white-light boundary curve and of the second white-light boundary curve, and (2) within a second area on a 1976 CIE Chromaticity Diagram which is enclosed by a first saturated light curve extending along all points representing saturated light having wavelength in the range of from about 390 nm to about 500 nm, a line segment extending from a point representing saturated light having wavelength of about 500 nm to a point representing saturated light having wavelength of about 560 nm, a second saturated light curve extending along all points representing saturated light having wavelength in the range of from about 560 nm to about 580 nm, and a line segment extending from a point representing saturated light having wavelength of about 580 nm to a point representing saturated light having wavelength of about 390 nm; and at least one supplemental light emitter having a dominant emission wavelength in the range of from about 600 nm to about 640 nm.

In some embodiments in accordance with the first aspect of the present inventive subject matter, which can include or not include, as suitable, any of the other features described herein:

the first group of non-white light sources comprises at least a first phosphor converted solid state light emitter that comprises a first excitation source that emits light having a first dominant wavelength, the first group of non-white light sources comprises at least a second phosphor converted solid state light emitter that comprises a second excitation source that emits light having a second dominant wavelength, and the first dominant wavelength differs from the second dominant wavelength by at least 5 nm.

In some embodiments in accordance with the first aspect of the present inventive subject matter, which can include or not include, as suitable, any of the other features described herein:

the first group of non-white light sources comprises at least a first phosphor light emitting diode comprising a light emitting diode having a dominant wavelength in the range of from about 430 nm to about 480 nm; and the first group of non-white light sources comprises at least a second phosphor light emitting diode comprising a light emitting diode having a dominant wavelength in the range of from about 450 nm to about 500 nm.

In some embodiments in accordance with the first aspect of the present inventive subject matter, which can include or not include, as suitable, any of the other features described herein:

the first group of non-white light sources comprises at least a first sub-group of non-white light sources and a second sub-group of non-white light sources, the first sub-group of non-white light sources, when illuminated, emit light having u', v' color coordinates which define a point which is (1) outside the first area, and (2) within the second area;

the second sub-group of non-white light sources, when illuminated, emit light having u', v' color coordinates which define a point which is (1) outside the first area, and (2) within the second area;

the first sub-group comprises at least a first excitation source that emits light having a first dominant wavelength, the second sub-group comprises a single illuminator having a second dominant wavelength, and the first dominant wavelength differs from the second dominant wavelength by at least 5 nm.

In some of such embodiments, which can include or not include, as suitable, any of the other features described herein:

the first group of non-white light sources further comprises a third sub-group of non-white light sources, the third sub-group of non-white light sources, when illuminated, emits light having u', v' color coordinates which define a point which is (1) outside the first area, and (2) within the second area;

the first sub-group of non-white light sources is electrically connected so as to be commonly energized;

the third sub-group of non-white light sources is electrically connected so as to be commonly energized and separately energized from the first sub-group of non-white light sources; and at least one of the second sub-group of non-white light sources is electrically connected so as to be commonly energized with the first sub-group of non-white light emitters, and/or at least one of the second sub-group of non-white light sources is electrically connected so as to be commonly energized with the third sub-group of non-white light emitters; and/or an excitation emitter of at least one light source of the second sub-group of non-white light sources has a dominant wavelength in the range of from about 475 nm to about 485 nm, and/or the first sub-group of non-white light sources is on a first string; the second sub-group of non-white light sources is on a second string; and the at least one supplemental light emitter is on a third string, and/or the first sub-group of non-white light sources comprises at least one phosphor converted solid state light emitter that comprises a first excitation source that emits light having a first dominant wavelength; the second sub-group of non-white light sources comprises at least one phosphor converted solid state light emitter that comprises a second excitation source that emits light having a second dominant wavelength; and the first dominant wavelength differs from the second dominant wavelength by at least 5 nm, and/or the first sub-group of non-white light sources emits light which is more blueish than light emitted by the second sub-group of non-white light sources, and the second sub-group of non-white light sources emits light which is more yellowish than light emitted by the first sub-group of non-white light sources, and/or the first sub-group of non-white light sources and the second sub-group of non-white light sources each comprise at least one light source having a FWHM value of at least 40 nm.

In some embodiments in accordance with the first aspect of the present inventive subject matter, which can include or not include, as suitable, any of the other features described herein:

when the first group of non-white light sources and the at least one supplemental light emitters are emitting light, a mixture of (1) light emitted from the lighting device which was emitted by the first group of non-white light sources, and (2) light emitted from the lighting device which was emitted by the at least one supplemental light emitter would, in the absence of any additional light, have a combined illumination having x, y color coordinates which is within 0.01 u'v' of at least one point on the blackbody locus on a 1976 CIE Chromaticity Diagram.

In some embodiments in accordance with the first aspect of the present inventive subject matter, which can include or not include, as suitable, any of the other features described herein:

the lighting device further comprises at least a first power line, and when energy is supplied to the first power line, the lighting device emits light which is within 0.01 u'v' of at least one point on the blackbody locus on a 1976 CIE Chromaticity Diagram.

In some embodiments in accordance with the first aspect of the present inventive subject matter, which can include or not include, as suitable, any of the other features described herein:

when the first group of non-white light sources and the at least one supplemental light emitter are emitting light, light emitted from the lighting device which was emitted by non-white light sources that emit light having a dominant wavelength in the range of from about 430 nm to about 480 nm comprises from about 40 percent to about 95 percent of the light emitted from the lighting device.

In some embodiments in accordance with the first aspect of the present inventive subject matter, which can include or not include, as suitable, any of the other features described herein:

the first group of non-white light sources comprises at least one solid state light emitter that has a peak emission wavelength in the range of from about 390 nm to about 480 nm.

In some embodiments in accordance with the first aspect of the present inventive subject matter, which can include or not include, as suitable, any of the other features described herein:

the first group of non-white light sources comprises at least a first luminescent material that has a dominant emission wavelength in the range of from about 560 nm to about 580 nm.

In some embodiments in accordance with the first aspect of the present inventive subject matter, which can include or not include, as suitable, any of the other features described herein:

at least one of the non-white light sources in the first group of non-white light sources, when illuminated, emits light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

In some embodiments in accordance with the first aspect of the present inventive subject matter, which can include or not include, as suitable, any of the other features described herein:

when the first group of non-white light sources and the at least one supplemental light emitter are emitting light, a mixture of (1) light emitted from the lighting device which was emitted by the first group of non-white light sources, and (2) light emitted from the lighting device which was emitted by the at least one supplemental light emitter would, in the absence of any additional light, have a correlated color temperature in the range of from about 2,000 K to about 11,000 K.

In some embodiments in accordance with the first aspect of the present inventive subject matter, which can include or not include, as suitable, any of the other features described herein:

when the first group of non-white light sources and the at least one supplemental light emitter are emitting light, a mixture of (1) light emitted from the lighting device which was emitted by the first group of non-white light sources, and (2) light emitted from the lighting device which was emitted by the at least one supplemental light emitter would, in the absence of any additional light, have a CRI of at least Ra 85.

In accordance with a second aspect of the present inventive subject matter, there is provided a lighting device comprising:

a first group of non-white light sources, the non-white light sources, when illuminated, emitting light having u', v' color coordinates which define a point which is (1) outside a first area on a 1976 CIE Chromaticity Diagram which is bounded by a first white-light boundary curve which is 0.01 u'v' above the planckian blackbody locus and a second white-light boundary curve which is 0.01 u'v' below the planckian blackbody locus and (2) within a second area on a 1976 CIE Chromaticity Diagram which is enclosed by a first saturated light curve extending along all points representing saturated light having wavelength in the range of from about 390 nm to about 500 nm, a line segment extending from a point representing saturated light having wavelength of about 500 nm to a point representing saturated light having wavelength of about 560 nm, a second saturated light curve extending along all points representing saturated light having wavelength in the range of from about 560 nm to about 580 nm, and a line segment extending from a point representing saturated light having wavelength of about 580 nm to a point representing saturated light having wavelength of about 390 nm;

at least one supplemental light emitter having a dominant emission wavelength in the range of from about 600 nm to about 640 nm, and means for generating light which mixes with light emitted by the first group of non-white light sources and light emitted by the at least one supplemental light emitter to produce mixed light that has a color point which is within 0.01 u'v' of at least one point on the blackbody locus on a 1976 CIE Chromaticity Diagram.

In accordance with a third aspect of the present inventive subject matter, there is provided a method of lighting, comprising:

supplying electricity to a first group of non-white light sources to cause the first group of non-white light sources to emit light having u', v' color coordinates which define a point which is (1) outside a first area on a 1976 CIE Chromaticity Diagram which is bounded by a first white-light boundary curve which is 0.01 u'v' above the planckian blackbody locus and a second white-light boundary curve which is 0.01 u'v' below the planckian blackbody locus and (2) within a second area on a 1976 CIE Chromaticity Diagram which is enclosed by a first saturated light curve extending along all points representing saturated light having wavelength in the range of from about 390 nm to about 500 nm, a line segment extending from a point representing saturated light having wavelength of about 500 nm to a point representing saturated light having wavelength of about 560 nm, a second saturated light curve extending along all points representing saturated light having wavelength in the range of from about 560 nm to about 580 nm, and a line segment extending from a point representing saturated light having wavelength of about 580 nm to a point representing saturated light having wavelength of about 390 nm; and supplying electricity to at least one supplemental light emitter to cause the at least one supplemental light emitter emit light having a dominant emission wavelength in the range of from about 600 nm to about 640 nm.

In some embodiments in accordance with the third aspect of the present inventive subject matter, which can include or not include, as suitable, any of the other features described herein:

the first group of non-white light sources comprises at least a first phosphor converted solid state light emitter that comprises a first excitation source that emits light having a first dominant wavelength, the first group of non-white light sources comprises at least a second phosphor converted solid state light emitter that comprises a second excitation source that emits light having a second dominant wavelength, and the first dominant wavelength that differs from the second dominant wavelength by at least 5 nm.

In some embodiments in accordance with the third aspect of the present inventive subject matter, which can include or not include, as suitable, any of the other features described herein:

the first group of non-white light sources comprises at least one phosphor light emitting diode comprising a light emitting diode having a dominant wavelength in the range of from about 430 nm to about 480 nm and at least one phosphor light emitting diode comprising a light emitting diode having a dominant wavelength in the range of from about 450 nm to about 500 nm.

In some embodiments in accordance with the third aspect of the present inventive subject matter, which can include or not include, as suitable, any of the other features described herein:

a mixture of (1) light emitted from the lighting device which was emitted by the first group of non-white light sources, and (2) light emitted from the lighting device which was emitted by the at least one supplemental light emitter has, in the absence of any additional light, a combined illumination having x, y color coordinates which is within 0.01 u'v' of at least one point on the blackbody locus on a 1976 CIE Chromaticity Diagram.

In accordance with a fourth aspect of the present inventive subject matter, there is provided a lighting device comprising:

a first group of non-white light sources, each of the non-white light sources, when illuminated, emitting light having u', v' color coordinates which define a point which is (1) outside a first area on a 1976 CIE Chromaticity Diagram which is bounded by a first white-light boundary curve which is 0.01 u'v' above the planckian blackbody locus and a second white-light boundary curve which is 0.01 u'v' below the planckian blackbody locus and (2) within a second area on a 1976 CIE Chromaticity Diagram which is enclosed by a first saturated light curve extending along all points representing saturated light having wavelength in the range of from about 430 nm to about 465 nm, a line segment extending from a point representing saturated light having wavelength of about 465 nm to a point representing saturated light having wavelength of about 560 nm, a second saturated light curve extending along all points representing saturated light having wavelength in the range of from about 560 nm to about 580 nm, and a line segment extending from a point representing saturated light having wavelength of about 580 nm to a point representing saturated light having wavelength of about 430 nm;

a second group of non-white light sources, each of the second group of non-white light sources, when illuminated, emitting light having u', v' color coordinates which define a point which is (1) outside the first area and (2) within the second area; and at least one supplemental light emitter, each of the at least one supplemental light emitter having a dominant emission wavelength in the range of from about 600 nm to about 640 nm.

In some embodiments in accordance with the fourth aspect of the present inventive subject matter, which can include or not include, as suitable, any of the other features described herein:

the first group of non-white light sources and the second group of non-white light sources each comprises at least a first light source solid state light emitter and at least a first luminescent material.

In some embodiments in accordance with the fourth aspect of the present inventive subject matter, which can include or not include, as suitable, any of the other features described herein:

the first group of non-white light sources and the second group of non-white light sources each comprise at least one light source having a FWHM value of at least 40 nm.

In some embodiments in accordance with the fourth aspect of the present inventive subject matter, which can include or not include, as suitable, any of the other features described herein:

when each of the first group of non-white light sources, each of the second group of non-white light sources and each of the first group of supplemental light emitters are emitting light, a mixture of (1) light emitted from the lighting device which was emitted by the first group of non-white light sources, (2) light emitted from the lighting device which was emitted by the second group of non-white light sources, and (3) light emitted from the lighting device which was emitted by the first group of supplemental light emitters would, in the absence of any additional light, have a combined illumination having x, y color coordinates which is within 0.01 u'v' of at least one point on the blackbody locus on a 1976 CIE Chromaticity Diagram.

In some embodiments in accordance with the fourth aspect of the present inventive subject matter, which can include or not include, as suitable, any of the other features described herein:

the lighting device further comprises at least a first power line, and when energy is supplied to the first power line, the lighting device emits light which is within 0.01 u'v' of at least one point on the blackbody locus on a 1976 CIE Chromaticity Diagram.

In some embodiments in accordance with the fourth aspect of the present inventive subject matter, which can include or not include, as suitable, any of the other features described herein:

when each of the first group of non-white light sources, each of the second group of non-white light sources and each of the first group of supplemental light emitters are emitting light, a mixture of (1) light emitted from the lighting device which was emitted by the first group of non-white light sources, (2) light emitted from the lighting device which was emitted by the second group of non-white light sources, and (3) light emitted from the lighting device which was emitted by the first group of supplemental light emitters would, in the absence of any additional light, have a correlated color temperature in the range of from about 2,000 K to about 11,000 K.

In some embodiments in accordance with the fourth aspect of the present inventive subject matter, which can include or not include, as suitable, any of the other features described herein:

when each of the first group of non-white light sources, each of the second group of non-white light sources and each of the first group of supplemental light emitters are emitting light, a mixture of (1) light emitted from the lighting device which was emitted by the first group of non-white light sources, (2) light emitted from the lighting device which was emitted by the second group of non-white light sources, and (3) light emitted from the lighting device which was emitted by the first group of supplemental light emitters would, in the absence of any additional light, have a CRI of at least Ra 85.

In some embodiments in accordance with the fourth aspect of the present inventive subject matter, which can include or not include, as suitable, any of the other features described herein:

when each of the first group of non-white light sources, each of the second group of non-white light sources and each of the first group of supplemental light emitters are emitting light, light emitted from the lighting device which was emitted by the first group of non-white light sources comprises from about 40 percent to about 95 percent of the light emitted from the lighting device.

In some of such embodiments, which can include or not include, as suitable, any of the other features described herein:

the first group of non-white light sources comprises at least one solid state light emitter that has a peak emission wavelength in the range of from about 390 nm to about 480 nm; and/or the first group of non-white light sources comprises at least a first luminescent material which has a dominant emission wavelength in the range of from about 560 nm to about 580 nm.

In some embodiments in accordance with the fourth aspect of the present inventive subject matter, which can include or not include, as suitable, any of the other features described herein:

each of the non-white light sources in the first group of non-white light sources, when illuminated, emits light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

In some embodiments in accordance with the fourth aspect of the present inventive subject matter, which can include or not include, as suitable, any of the other features described herein:

the second group of non-white light sources consists of a single illuminator.

In some embodiments in accordance with the fourth aspect of the present inventive subject matter, which can include or not include, as suitable, any of the other features described herein:

the lighting device further comprises a third group of non-white light sources, each of the third group of non-white light sources, when illuminated, emitting light having u', v' color coordinates which define a point which is (1) outside the first area, and (2) within the second area;

the first group of non-white light sources is electrically connected so as to be commonly energized;

the third group of non-white light sources is electrically connected so as to be commonly energized and separately energized from the first group of non-white light sources; and at least one of the second group of non-white light sources is electrically connected so as to be commonly energized with the first group of non-white light emitters.

In some of such embodiments, which can include or not include, as suitable, any of the other features described herein:

at least one of the second group of non-white light sources is electrically connected so as to be commonly energized with the third group of non-white light emitters; and/or the first group of non-white light emitters and the third group of non-white light emitters have respective color points such that at least a portion of a tie line between the respective color points on the CIE31 Chromaticity Diagram is contained within a region bounded by the points having x, y coordinates of about 0.3528,0.4414; 0.3640,0.4629; 0.3953,0.4487; and 0.3845, 0.4296; and/or an excitation emitter of light sources of the second group of non-white light sources has a dominant wavelength in the range of from about 475 nm to about 485 nm; and/or the lighting device has a Color Temperature of from about 2500 K to about 4000 K and a color point within about 4 MacAdam ellipses of the blackbody locus; and/or the first group of non-white light sources and the third group of non-white light sources have respective color points such that at least a portion of a tie line between the respective color points on the CIE31 Chromaticity Diagram is contained within a region bounded by the points having x, y coordinates of about 0.3318,0.4013; 0.3426,0.4219; 0.3747,0.4122; and 0.3643, 0.3937; and/or an excitation emitter of light sources of the second group of non-white light sources has a dominant wavelength in the range of from about 475 nm to about 485 nm; and/or the lighting device has a Color Temperature of about 4000K and a color point within about 4 MacAdam ellipses of the blackbody locus.

In some embodiments in accordance with the fourth aspect of the present inventive subject matter, which can include or not include, as suitable, any of the other features described herein:

the first group of non-white light sources comprises at least one phosphor light emitting diode comprising a light emitting diode having a dominant wavelength in the range of from about 430 nm to about 480 nm and the second group of non-white light sources comprises at least one phosphor light emitting diode comprising a light emitting diode having a dominant wavelength in the range of from about 450 nm to about 500 nm.

In accordance with a fifth aspect of the present inventive subject matter, there is provided a method comprising:

supplying electricity to a first group of non-white light sources to cause the first group of non-white light sources to emit light having u', v' color coordinates which define a point which is (1) outside a first area on a 1976 CIE Chromaticity Diagram which is bounded by a first white-light boundary curve which is 0.01 u'v' above the planckian blackbody locus and a second white-light boundary curve which is 0.01 u'v' below the planckian blackbody locus and (2) within a second area on a 1976 CIE Chromaticity Diagram which is enclosed by a first saturated light curve extending along all points representing saturated light having wavelength in the range of from about 430 nm to about 465 nm, a line segment extending from a point representing saturated light having wavelength of about 465 nm to a point representing saturated light having wavelength of about 560 nm, a second saturated light curve extending along all points representing saturated light having wavelength in the range of from about 560 nm to about 580 nm, and a line segment extending from a point representing saturated light having wavelength of about 580 nm to a point representing saturated light having wavelength of about 430 nm;

supplying electricity to a second group of non-white light sources to cause the second group of non-white light sources to emit light having u', v' color coordinates which define a point which is (1) outside the first area and (2) within the second area; and supplying electricity to at least one supplemental light emitter to cause the at least one supplemental light emitter emit light having a dominant emission wavelength in the range of from about 600 nm to about 640 nm.

In some embodiments in accordance with the fifth aspect of the present inventive subject matter, which can include or not include, as suitable, any of the other features described herein:

the first group of non-white light sources comprises at least a first phosphor converted solid state light emitter that comprises a first excitation source that emits light having a first dominant wavelength, the second group of non-white light sources comprises at least a second phosphor converted solid state light emitter that comprises a second excitation source that emits light having a second dominant wavelength, and the first dominant wavelength that differs from the second dominant wavelength by at least 5 nm.

In some embodiments in accordance with the fifth aspect of the present inventive subject matter, which can include or not include, as suitable, any of the other features described herein:

the first group of non-white light sources comprises at least one phosphor light emitting diode comprising a light emitting diode having a dominant wavelength in the range of from about 430 nm to about 480 nm and the second group of non-white light sources comprises at least one phosphor light emitting diode comprising a light emitting diode having a dominant wavelength in the range of from about 450 nm to about 500 nm.

In accordance with a sixth aspect of the present inventive subject matter, there is provided a lighting device comprising:

a first group of non-white light sources, each of the non-white light sources, when illuminated, emitting light having u', v' color coordinates which define a point which is (1) outside a first area on a 1976 CIE Chromaticity Diagram which is bounded by a first white-light boundary curve which is 0.01 u'v' above the planckian blackbody locus and a second white-light boundary curve which is 0.01 u'v' below the planckian blackbody locus and (2) within a second area on a 1976 CIE Chromaticity Diagram which is enclosed by a first saturated light curve extending along all points representing saturated light having wavelength in the range of from about 430 nm to about 465 nm, a line segment extending from a point representing saturated light having wavelength of about 465 nm to a point representing saturated light having wavelength of about 560 nm, a second saturated light curve extending along all points representing saturated light having wavelength in the range of from about 560 nm to about 580 nm, and a line segment extending from a point representing saturated light having wavelength of about 580 nm to a point representing saturated light having wavelength of about 430 nm;

at least one supplemental light emitter, each of the at least one supplemental light emitter having a dominant emission wavelength in the range of from about 600 nm to about 640 nm, and means for generating light which mixes with light emitted by the first group of non-white light sources and light emitted by the at least one supplemental light emitter to produce mixed light that has a color point which is within 0.01 u'v' of at least one point on the blackbody locus on a 1976 CIE Chromaticity Diagram.

In accordance with a seventh aspect of the present inventive subject matter, there is provided a lighting device comprising:

a first string comprising a first group of non-white light sources, each of the first group of non-white light sources, when illuminated, emitting light having u', v' color coordinates which define a point which is (1) outside a first area on a 1976 CIE Chromaticity Diagram which is bounded by a first white-light boundary curve which is 0.01 u'v' above the planckian blackbody locus and a second white-light boundary curve which is 0.01 u'v' below the planckian blackbody locus and (2) within a second area on a 1976 CIE Chromaticity Diagram enclosed by a first saturated light curve extending along all points representing saturated light having wavelength in the range of from about 430 nm to about 480 nm, a first line segment extending from a point representing saturated light having wavelength of about 480 nm to a point representing saturated light having wavelength of about 560 nm, a second saturated light curve extending along all points representing saturated light having wavelength in the range of from about 560 nm to about 580 nm, and a second line segment extending from a point representing saturated light having wavelength of about 580 nm to a point representing saturated light having wavelength of about 430 nm, the first group of non-white light sources comprising at least first and second phosphor converted solid state light emitters where a first excitation source of the first phosphor converted solid state light emitter and a second excitation source of the second phosphor converted solid state light emitter have dominant wavelengths that differ by at least 5 nm;

a second string comprising a second group of non-white light sources, each of the second group of non-white light sources, when illuminated, emitting light having u', v' color coordinates which define a point which is (1) outside the first area and (2) within the second area; and a third string comprising a first group of supplemental light emitters, each of the first group of supplemental light emitters having a dominant emission wavelength in the range of from about 600 nm to about 640 nm.

In some embodiments in accordance with the seventh aspect of the present inventive subject matter, which can include or not include, as suitable, any of the other features described herein:

the second group of non-white light sources comprises at least third and fourth phosphor converted solid state light emitters where a third excitation source of the third phosphor converted solid state light emitter and a fourth excitation source of the fourth phosphor converted solid state light emitter have dominant wavelengths that differ by at least 5 nm.

In some of such embodiments, which can include or not include, as suitable, any of the other features described herein, the non-white light source that has the first excitation source emits light which is within a first color bin having a chromaticity region bounded by line segments extending between coordinates on a CIE31 Chromaticity diagram of 0.3577, 0.4508; 0.3892, 0.4380; 0.3845, 0.4296; and 0.3528, 0.4414, and the non-white light source that has the third excitation source emits light which is within a second color bin having chromaticity region bounded by line segments extending between coordinates on a CIE31 Chromaticity diagram of 0.3640, 0.4629; 0.3953, 0.4487; 0.3892, 0.438; and 0.3577, 0.4508.

In some embodiments in accordance with the seventh aspect of the present inventive subject matter, which can include or not include, as suitable, any of the other features described herein:

the first group of non-white light sources emits light which is more blueish than light emitted by the second group of non-white light sources, and the second group of non-white light sources emits light which is more yellowish than light emitted by the first group of non-white light sources.

In some embodiments in accordance with the seventh aspect of the present inventive subject matter, which can include or not include, as suitable, any of the other features described herein:

when each of the first group of non-white light sources, each of the at least one supplemental light emitter and each of the second group of non-white light sources is emitting light, a mixture of (1) light emitted from the lighting device which was emitted by the first group of non-white light sources, (2)

light emitted from the lighting device which was emitted by the at least one supplemental light emitter, and (3) light emitted from the lighting device which was emitted by the second group of non-white light sources would, in the absence of any additional light, have a CRI of at least Ra 85.

In some embodiments in accordance with the seventh aspect of the present inventive subject matter, which can include or not include, as suitable, any of the other features described herein:

when each of the first group of non-white light sources, each of the at least one supplemental light emitter and each of the second group of non-white light sources is emitting light, a mixture of (1) light emitted from the lighting device which was emitted by the first group of non-white light sources, (2) light emitted from the lighting device which was emitted by the at least one supplemental light emitter, and (3) light emitted from the lighting device which was emitted by the second group of non-white light sources would, in the absence of any additional light, have a correlated color temperature in the range of from about 2,000 K to about 11,000 K.

In embodiments that comprise BSY LEDs and BSR LEDs, the LEDs in the BSY LEDs (i.e., the excitation emitters) are shorter wavelength LEDs and the LEDs in the BSR LEDs are longer wavelength LEDs. In other embodiments that comprise BSY LEDs and BSR LEDs, the LEDs in the BSY LEDs are longer wavelength LEDs and the LEDs in the BSR LEDs are shorter wavelength LEDs. In other embodiments that comprise BSY LEDs and BSR LEDs, the LEDs in the BSY LEDs can include longer wavelength LEDs and/or shorter wavelength LEDs, and the LEDs in the BSR LEDs can include longer wavelength LEDs and/or shorter wavelength LEDs, so long as the BSY LEDs and/or the BSR LEDs comprise at least one longer wavelength LED and the BSY LEDs and/or the BSR LEDs comprise at least one shorter wavelength LED. Any of such embodiments can further comprise one or more LEDs that emit in any other wavelength range or ranges.

In embodiments that comprise BSY LEDs and BSG LEDs, the LEDs in the BSY LEDs (i.e., the excitation emitters) are shorter wavelength LEDs and the LEDs in the BSG LEDs are longer wavelength LEDs. In other embodiments that comprise BSY LEDs and BSG LEDs, the LEDs in the BSY LEDs are longer wavelength LEDs and the LEDs in the BSG LEDs are shorter wavelength LEDs. In other embodiments that comprise BSY LEDs and BSG LEDs, the LEDs in the BSY LEDs can include longer wavelength LEDs and/or shorter wavelength LEDs, and the LEDs in the BSG LEDs can include longer wavelength LEDs and/or shorter wavelength LEDs, so long as the BSY LEDs and/or the BSG LEDs comprise at least one longer wavelength LED and the BSY LEDs and/or the BSG LEDs comprise at least one shorter wavelength LED. Any of such embodiments can further comprise one or more LEDs that emit in any other wavelength range or ranges.

In embodiments that comprise BSY LEDs, BSR LEDs and BSG LEDs, the LEDs in the BSY LEDs (i.e., the excitation emitters) are shorter wavelength LEDs and the LEDs in the BSR LEDs and the BSG LEDs are longer wavelength LEDs. In other embodiments that comprise BSY LEDs, BSR LEDs and BSG LEDs, the LEDs in the BSY LEDs can include longer wavelength LEDs and/or shorter wavelength LEDs, the LEDs in the BSR LEDs can include longer wavelength LEDs and/or shorter wavelength LEDs, and the LEDs in the BSG LEDs can include longer wavelength LEDs and/or shorter wavelength LEDs, so long as the combination of BSY LEDs, BSR LEDs and BSG LEDs comprise at least one longer wavelength LED and at least one shorter wavelength LED. Any of such embodiments can further comprise one or more LEDs that emit in any other wavelength range or ranges.

In some embodiments, phosphor that can be used to make a BSY LED, phosphor that can be used to make a BSR LED and/or phosphor that can be used to make a BSG LED can be mixed in any suitable way, and any of such mixtures can be excited by one or more excitation sources that can include shorter wavelength LEDs and/or longer wavelength LEDs (and/or LEDs that emit in any other wavelength ranges).

In particular embodiments, the two (or more) different wavelength blue (and/or cyan, and/or green) excitation sources are provided by blue (and/or cyan, and/or green) solid state light emitters that have dominant wavelengths that differ by 5 nm, and in other embodiments, they differ by 10 nm, 15 nm, 20 nm or 25 nm. In some embodiments, a first group of phosphor converted light emitters has an excitation source with a dominant wavelength of from about 430 nm to about 480 nm and a second group of phosphor converted light emitters has an excitation source with a dominant wavelength of from about 450 nm to about 500 nm. In particular embodiments, the first group of phosphor converted light emitters has an excitation source with a dominant wavelength of from about 440 nm to about 460 nm and the second group of phosphor converted light emitters has an excitation source with a dominant wavelength of from about 450 nm to about 480 nm. In still further embodiments, the first group of phosphor converted light emitters has an excitation source with a dominant wavelength of from about 450 nm to about 452 nm and a second group of phosphor converted light emitters has an excitation source with a dominant wavelength of from about 468 nm to about 474 nm. In some embodiments, a first group of phosphor converted light emitters has an excitation source with a dominant wavelength of from about 430 nm to about 450 nm and a second group of phosphor converted light emitters has an excitation source with a dominant wavelength of from about 450 nm to about 500 nm. In some embodiments, any suitable number of different wavelength blue (and/or cyan and/or green) excitation sources are provided, e.g., instead of two groups, there can be three groups, four groups, five groups, etc. (in which respective excitation sources in the different groups have respective dominant wavelengths that differ by 5 nm, 10 nm, 15 nm, 20 nm, 25 nm, etc., e.g., a first group of phosphor converted light emitters having an excitation source with a dominant wavelength of from about 430 nm to about 460 nm, a second group of phosphor converted light emitters having an excitation source with a dominant wavelength of from about 450 nm to about 480 nm and a third group of phosphor converted light emitters having an excitation source with a dominant wavelength of from about 460 nm to about 500 nm.

In some embodiments, a first group of BSY LEDs is provided (and in some embodiments at least first and second groups of BSY LEDs are provided), at least one long wavelength BSY (LWBSY) LED is provided and at least one red/orange LED is provided such that the combined light output of the first and second groups, the at least one LWBSY and the at least one red/orange LED is white light. In particular embodiments, the white light has a CRI of greater than 85, greater than 90, greater than 92 or greater than 95. In some embodiments, at least two LWBSY LEDs are provided. The LWBSY LEDs may be from color bins that correspond to color bins of the BSY LEDs shifted by a difference between the tie lines between the phosphor dominant wavelength and the excitation wavelength of the BSY LEDs and the phosphor dominant wavelength and the excitation wavelength of the LWBSY LEDs. In particular embodiments, the BSY LEDs and the LWBSY LEDs are from a same brightness bin. In other embodiments, the BSY LEDs and the LWBSY LEDs are selected from different brightness bins to provide an average brightness. In particular embodiments, the LWBSY LEDs may be from a dimmer brightness bin.

In some embodiments, the BSY LEDs provide overall color contributions that correspond to the overall color contributions set forth in Table 2 of U.S. patent application Ser. No. 12/248,220, filed on Oct. 9, 2008 (now U.S. Patent Publication No. 2009/0184616) (referred to below as "Table 2"), the entirety of which is hereby incorporated by reference as if set forth in its entirety, i.e., in some embodiments of the present inventive subject matter, (1) the percentage of all light emitted by the lighting device that is emitted by phosphor (i.e., resulting from excitation by light from the LWBSY LED(s) and/or from excitation by light from the shorter blue wavelength LEDs) corresponds to "PL % L" minus ("blue %"×10) in Table 2, (2) the percentage of all light emitted by the lighting device that is emitted by blue light emitting diodes (and/or cyan light emitting diodes and/or green light emitting diodes) corresponds to BCG % L plus ("blue %"×10) in Table 2, and (3) the percentage of all light emitted by the lighting device that is emitted by red/orange light emitting diodes corresponds to "RO % L" in Table 2.

By providing a long wavelength blue contribution as an excitation source of a phosphor converted LED, a same power supply topology as with a system with phosphor converted LEDs with a single wavelength excitation source can be employed. Such may be the case because the different phosphor converted LEDs can be from similar brightness bins. Additional blue light from the LW excitation source (i.e., the LW BSY LEDs) that would otherwise require a dim blue LED or a different drive current can be advantageously converted by the phosphor. Furthermore, because the additional LW blue is provided as a phosphor converted LED, the likelihood of a blue "hot spot" showing through a diffuser may be reduced. Thus, CRI may be maintained or improved even in the presence of shorter wavelength blue excitation sources.

DETAILED DESCRIPTION OF THE INVENTIVE SUBJECT MATTER

Figure 1:
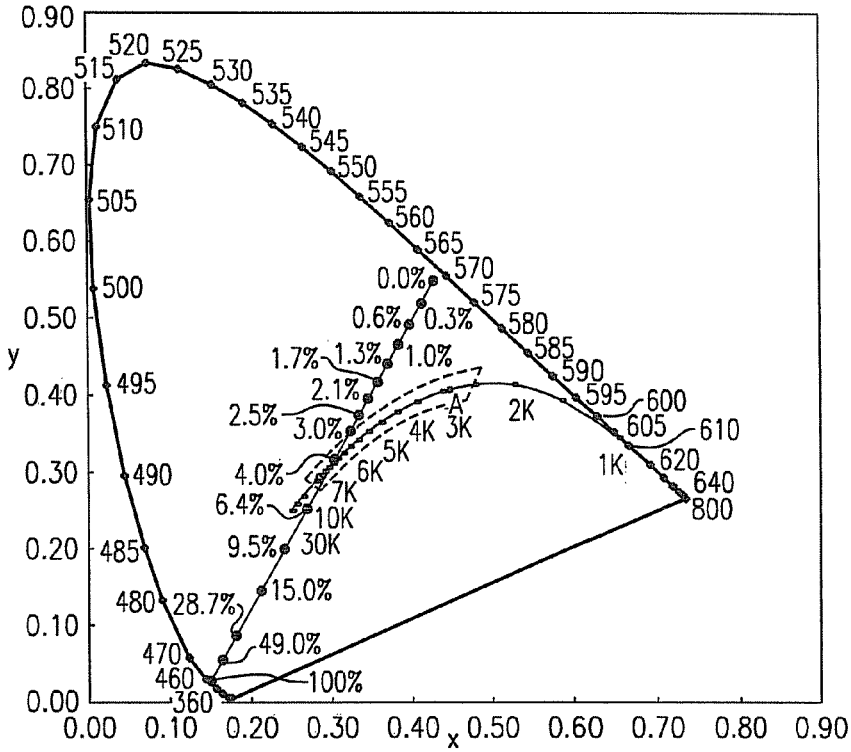
FIG. 1 is a CIE diagram illustrating a tie line between a blue LED and a yellow phosphor.
Figure 2:
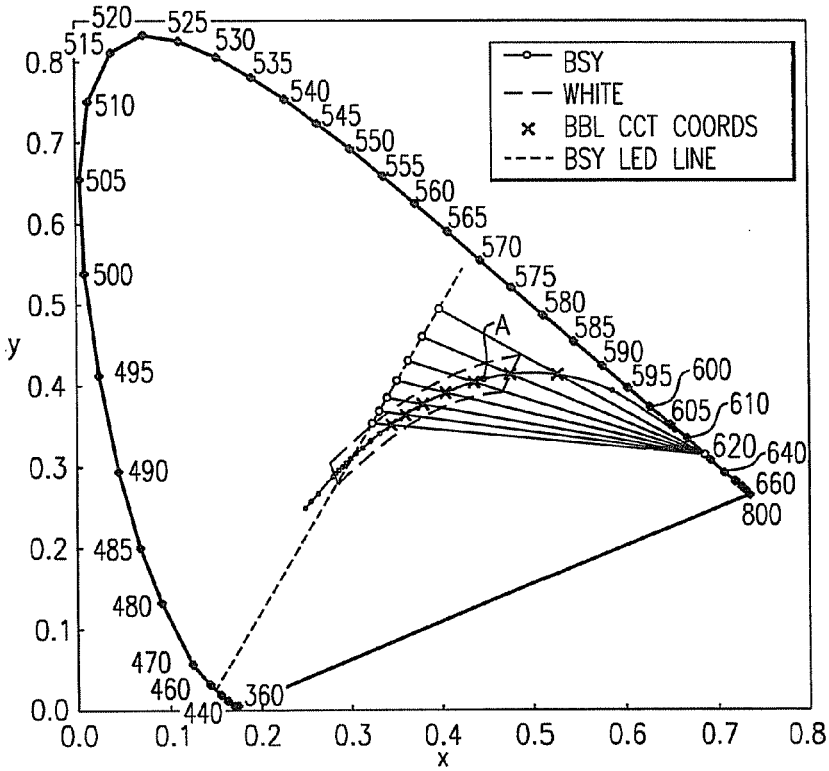
FIG. 2 is a CIE diagram illustrating the generation of white light by combining a non-saturated non-white phosphor converted LED with a red/orange LED.
Figure 3:
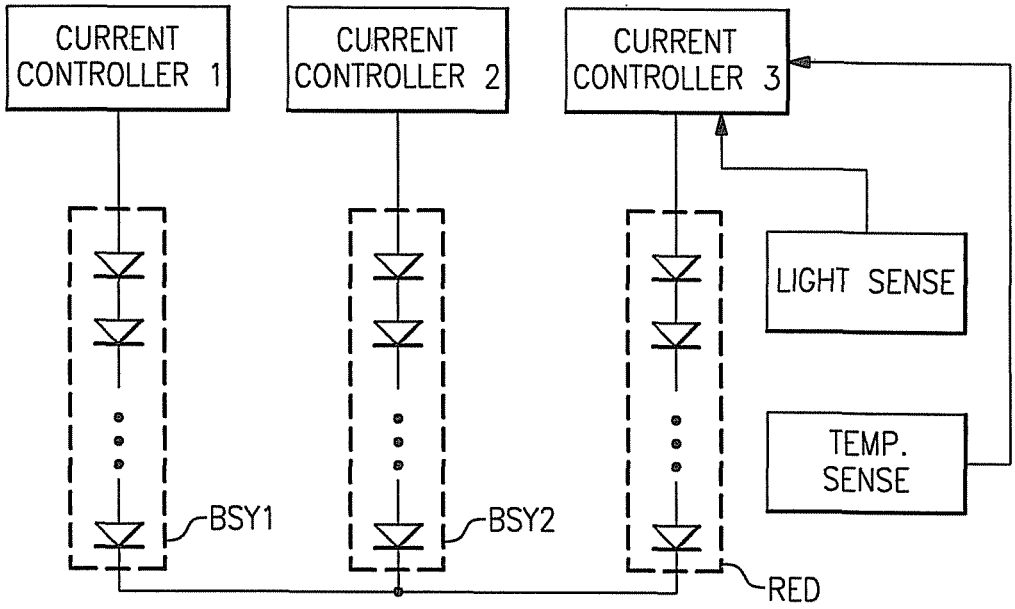
FIG. 3 is a schematic diagram of the LR6 and LR24 fixtures.
Figure 4:
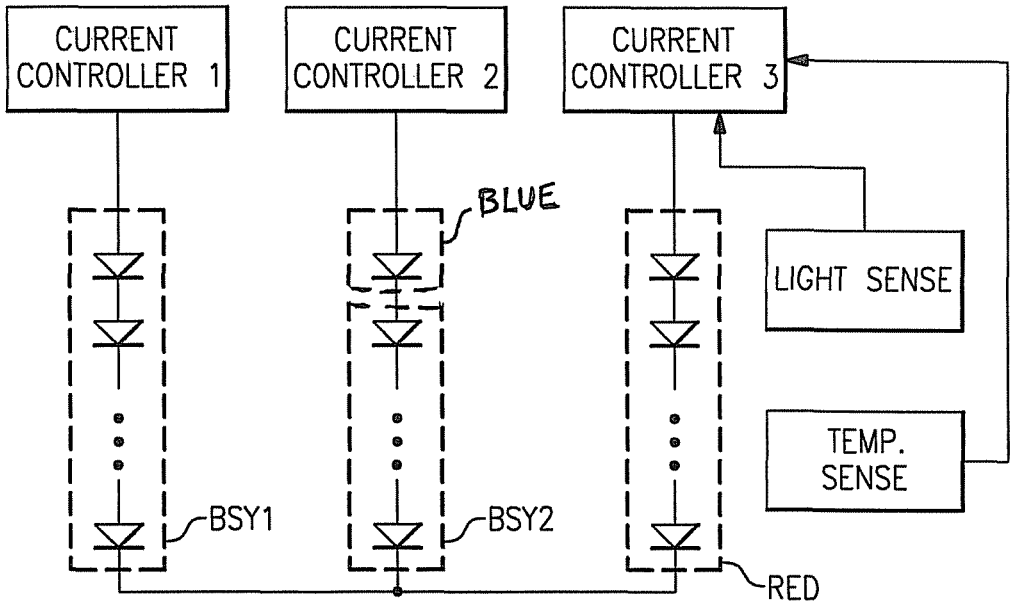
FIG. 4 is a schematic diagram of a luminaire combining a blue LED in a same string as a non-white phosphor LED.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Furthermore, relative terms, such as "lower" or "bottom" and "upper" or "top," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The expression "illumination" (or "illuminated"), as used herein when referring to a solid state light emitter, means that at least some current is being supplied to the solid state light emitter to cause the solid state light emitter to emit at least some electromagnetic radiation (e.g., visible light). The expression "illuminated" encompasses situations where the solid state light emitter emits electromagnetic radiation continuously, or intermittently at a rate such that a human eye would perceive it as emitting electromagnetic radiation continuously or intermittently, or where a plurality of solid state light emitters of the same color or different colors are emitting electromagnetic radiation intermittently and/or alternatingly (with or without overlap in "on" times), e.g., in such a way that a human eye would perceive them as emitting light continuously or intermittently (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials that emit light of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosure (uniformly or non-uniformly).

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

The expression "dominant emission wavelength", as used herein, means (1) in the case of a solid state light emitter, the dominant wavelength of light that the solid state light emitter emits if it is illuminated, and (2) in the case of a luminescent material, the dominant wavelength of light that the luminescent material emits if it is excited.

The expression "peak emission wavelength", as used herein, means (1) in the case of a solid state light emitter, the peak wavelength of light that the solid state light emitter emits if it is illuminated, and (2) in the case of a luminescent material, the peak wavelength of light that the luminescent material emits if it is excited.

The expression "correlated color temperature" is used according to its well-known meaning to refer to the temperature of a blackbody that is, in a well-defined sense (i.e., can be readily and precisely determined by those skilled in the art), nearest in color. The "color temperature" of a lighting device is the correlated color temperature of light that is emitted by that lighting device.

The expression "hue", as used herein, means light that has a color shade and saturation that correspond to a specific point on a CIE Chromaticity Diagram, i.e., a point that can be characterized with x,y coordinates on the 1931 CIE Chromaticity Diagram or with u', v' coordinates on the 1976 CIE Chromaticity Diagram. The expression "color point" refers to the coordinates of a specific point on a CIE Chromaticity Diagram, or to the hue of a color having such coordinates.

The expression "color bin" refers to a region on a CIE Chromaticity Diagram bounded by line segments that connect specific color points. A light emitter (e.g., an LED or a phosphor LED) may be characterized as being selected from a color bin having specific chromaticity region bounding coordinates, i.e., to indicate that the light emitted by the light emitter falls on a point that is inside the region on a CIE Chromaticity Diagram that is bounded by line segments that connect the specified coordinates.

The expression "dominant wavelength", is used herein according to its well-known and accepted meaning to refer to the perceived color of a spectrum, i.e., the single wavelength of light which produces a color sensation most similar to the color sensation perceived from viewing light emitted by the light source (i.e., it is roughly akin to "hue"), as opposed to "peak wavelength", which is well-known to refer to the spectral line with the greatest power in the spectral power distribution of the light source. Because the human eye does not perceive all wavelengths equally (it perceives yellow and green better than red and blue), and because the light emitted by many solid state light emitter (e.g., LEDs) is actually a range of wavelengths, the color perceived (i.e., the dominant wavelength) is not necessarily equal to (and often differs from) the wavelength with the highest power (peak wavelength). A truly monochromatic light such as a laser has the same dominant and peak wavelengths.

The expression "commonly energized", as used herein, means that the items described as being commonly energized are on a common energy supply structure (e.g., a common power line), such that when energy is being supplied to a first item, energy is necessarily also being supplied to the other item or items which are described as being "commonly energized" with the first item.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

Any desired solid state light emitter or emitters can be employed in accordance with the present inventive subject matter. Persons of skill in the art are aware of, and have ready access to, a wide variety of such emitters. Such solid state light emitters include inorganic and organic light emitters. Examples of types of such light emitters include a wide variety of light emitting diodes (inorganic or organic, including polymer light emitting diodes (PLEDs)), laser diodes, thin film electroluminescent devices, light emitting polymers (LEPs), a variety of each of which are well-known in the art (and therefore it is not necessary to describe in detail such devices, and/or the materials out of which such devices are made).

The lighting devices according to the present inventive subject matter can comprise any desired number of solid state emitters. For example, a lighting device according to the present inventive subject matter can include 50 or more light emitting diodes, or can include 100 or more light emitting diodes, etc.

A solid state light emitter in any lighting device according to the present inventive subject matter can be of any suitable size (or sizes), e.g., and any quantity (or respective quantities) of solid state light emitters of one or more sizes can be employed in the lighting device. In some instances, for example, a greater quantity of smaller solid state light emitters can be substituted for a smaller quantity of larger solid state light emitters, or vice-versa.

A wide variety of luminescent materials (also known as lumiphors or luminophoric media, e.g., as disclosed in U.S. Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished in a variety of ways, one representative way being by adding the luminescent materials to a clear or transparent encapsulant material (e.g., epoxy-based, silicone-based, glass-based or metal oxide-based material) as discussed above, for example by a blending or coating process.

As noted above, in some embodiments according to the present inventive subject matter, the non-white light source comprises at least one phosphor-LED. Phosphor-LEDs are made by coating, or surrounding, or having in proximity to a light emitting diode (i.e., an "excitation emitter", e.g., which emits blue or violet-blue or violet light), a luminescent material that is excited by the light-emitting-diode's light. Often, the luminescent material is chosen to emit yellow light, as a combination of blue and yellow light can make white light. A phosphor often used is YAG:Ce. The light emitted by the luminescent material can be combined with a portion of the light emitted by the light-emitting-diode, and the combined light has a hue and purity different from either the light-emitting-diode or the phosphor.

"White LEDs" (i.e., white LED lamps) are commonly produced using a light-emitting-diode that emits light around 455 nm and a phosphor YAG:Ce which has a yellow dominant wavelength of around 570 nm. In many instances, the portion of the lumens blue light is greater than approximately 3% and less than approximately 7%, and the combined emitted light appears white and falls within the generally acceptable color boundaries of light suitable for illumination.

The efficacy of such phosphor lamps will ideally increase continuously as a greater portion of the blue light is converted to yellow, due to the sensitivity of the eye, which is much more sensitive to yellow light than to blue light. In practice, however, the efficiency of the combined light peaks, as some of the blue light is lost due to parasitic absorption, and a greater portion of the yellow light is re-absorbed due to the thicker phosphor layer required. The peak efficacy and the color temperature of the peak efficacy is typically at around 2 percent blue lumens output.

Other combinations can use light emitting diodes between 405 nm and 490 nm, and luminescent materials having a dominant wavelength emission in the range of from 550 nm to 600 nm.

Methods to increase the CRI of such lamps have been described by others and include adding a red phosphor with the yellow phosphor to increase the red light emitted. Such methods have achieved very high CRT, in some cases Ra as high as 96, but due to the Stokes losses associated with using a blue excited red phosphor, efficacy is generally very low.

The present inventors, van de Ven and Negley, have disclosed lighting devices comprising a phosphor LED, generally with a yellowish hue, combined with a red LED, which achieves improved CRI and efficacy of the mixed light (see, e.g.:

(1) e.g., U.S. Patent Application No. 60/793,524, filed on Apr. 20, 2006, entitled "LIGHTING DEVICE AND LIGHTING METHOD" and U.S. patent application Ser. No. 11/736,761 (now U.S. Patent Publication No. 2007/0278934), filed Apr. 18, 2007, the entireties of which are hereby incorporated by reference;

(2) U.S. Patent Application No. 60/793,518, filed on Apr. 20, 2006, entitled "LIGHTING DEVICE AND LIGHTING METHOD" and U.S. patent application Ser. No. 11/736,799 (now U.S. Patent Publication No. 2007/0267983), filed Apr. 18, 2007, the entireties of which are hereby incorporated by reference;

(3) U.S. Patent Application No. 60/793,530, filed on Apr. 20, 2006, entitled "LIGHTING DEVICE AND LIGHTING METHOD" and U.S. patent application Ser. No. 11/737,321 (now U.S. Patent Publication No. 2007/0278503), filed Apr. 19, 2007, the entireties of which are hereby incorporated by reference;

(4) U.S. Patent Application No. 60/857,305, filed on Nov. 7, 2006, entitled "LIGHTING DEVICE AND LIGHT- ING METHOD" and U.S. patent application Ser. No. 11/936,163 (now U.S. Patent Publication No. 2008/0106895), filed Nov. 7, 2007, the entireties of which are hereby incorporated by reference;

(5) U.S. Pat. No. 7,213,940, issued on May 8, 2007, entitled "LIGHTING DEVICE AND LIGHTING METHOD" , the entirety of which is hereby incorporated by reference, U.S. Patent Application No. 60/868,134, filed on Dec. 1, 2006, entitled "LIGHTING DEVICE AND LIGHTING METHOD" , the entirety of which is hereby incorporated by reference, U.S. patent application Ser. No. 11/948,021 (now U.S. Patent Publication No. 2008/0130285), filed on Nov. 30, 2007, entitled "LIGHTING DEVICE AND LIGHTING METHOD" , the entirety of which is hereby incorporated by reference, U.S. patent application Ser. No. 12/475,850, filed on Jun. 1, 2009 (now U.S. Patent Publication No. 2009-0296384), the entirety of which is hereby incorporated by reference as if set forth in its entirety; and (6) U.S. Patent Application No. 60/868,986, filed on Dec. 7, 2006, entitled "LIGHTING DEVICE AND LIGHTING METHOD" , and U.S. patent application Ser. No. 11/951,626 (now U.S. Patent Publication No. 2008/0136313), filed Dec. 6, 2007, the entireties of which are hereby incorporated by reference). The regions of the CIE diagram for the various non-white phosphor converted LEDs described in these patent applications are collectively referred to herein as "BSY" LEDs.

With regard to mixed light output from the lighting devices according to the present inventive subject matter, certain embodiments of the present inventive subject matter are further directed to such mixed light in the proximity of light on the blackbody locus having color temperature of 2700 K, 3000 K or 3500 K, namely:

mixed light having x, y color coordinates which are within an area on a 1931 CI Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.4578, 0.4101, the second point having x, y coordinates of 0.4813, 0.4319, the third point having x, y coordinates of 0.4562, 0.4260, the fourth point having x, y coordinates of 0.4373, 0.3893, and the fifth point having x, y coordinates of 0.4593, 0.3944 (i.e., proximate to 2700 K); or mixed light having x, y color coordinates which are within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.4338, 0.4030, the second point having x, y coordinates of 0.4562, 0.4260, the third point having x, y coordinates of 0.4299, 0.4165, the fourth point having x, y coordinates of 0.4147, 0.3814, and the fifth point having x, y coordinates of 0.4373, 0.3893 (i.e., proximate to 3000 K); or mixed light having x, y color coordinates which are within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.4073, 0.3930, the second point having x, y coordinates of 0.4299, 0.4165, the third point having x, y coordinates of 0.3996, 0.4015, the fourth point having x, y coordinates of 0.3889, 0.3690, and the fifth point having x, y coordinates of 0.4147, 0.3814 (i.e., proximate to 3500 K).

The present inventive subject matter is further directed to an illuminated enclosure, comprising an enclosed space and at least one lighting device as described herein, wherein the lighting device illuminates at least a portion of the enclosure.

The present inventive subject matter is further directed to an illuminated surface, comprising a surface and at least one lighting device as described herein, wherein if the lighting device is illuminated, the lighting device would illuminate at least a portion of the surface.

The present inventive subject matter is further directed to methods which comprise making lighting devices in accordance with the present inventive subject matter.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

Figure 5:
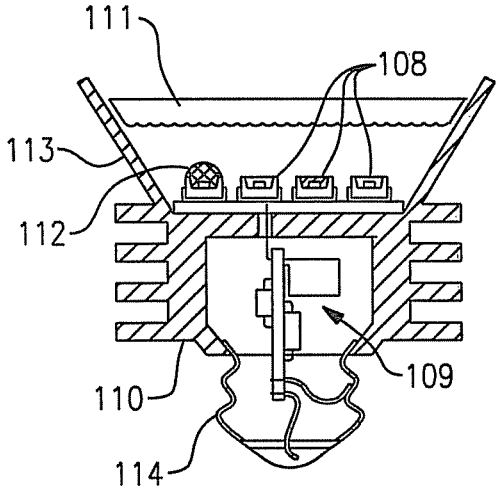
FIG. 5 is an exemplary luminaire incorporating some embodiments of the present inventive subject matter.

FIG. 5 is a cutaway side view of an embodiment of a lighting device provided as a self ballasted lamp according to the present inventive subject matter, including LEDs 108, a power supply unit (PSU) and controller 109, a heat sink 110, a textured diffuser 111, a light/color sensor 112, a reflector 113 and a power connector 114. Such a self-ballasted lamp may be provided by incorporating the combination of light emitters described herein in the self-ballasted lamps as described in U.S. Patent Application No. 60/861,824, filed on Nov. 30, 2006 entitled "SELF-BALLASTED SOLID STATE LIGHTING DEVICES" , U.S. Patent Application No. 60/916,664, filed May 8, 2007 , and U.S. patent application Ser. No. 11/947,392 (now U.S. Patent Publication No. 2008/0130298), filed on Nov. 29, 2007 , the entireties of which are hereby incorporated by reference.

Figure 6:
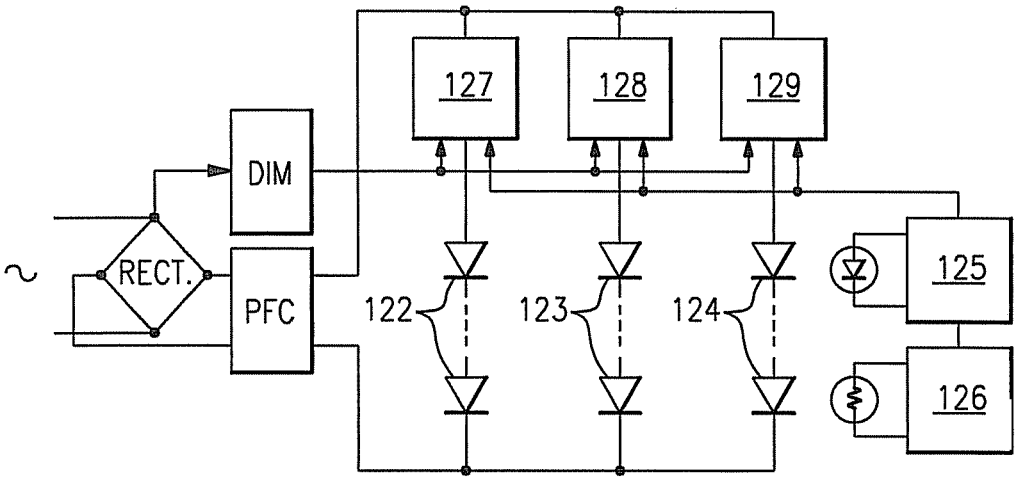
FIG. 6 is a diagram of a linear arrangement of LEDs incorporating some embodiments of the present inventive subject matter.

FIG. 6 is a schematic block diagram of an electrical and control circuit of an embodiment of a lighting device according to the present inventive subject matter. In the circuit illustrated in FIG. 6, the phosphor LEDs 122, the RO LEDs 123 and the LWBSY LEDs 124 may be controlled so as to control the combined color produced by the LEDs to be on or near the BBL. While the individual strings of LEDs (the expression "string", as used herein, means that at least two solid state light emitters are electrically connected in series) illustrated in FIG. 6 may be separately controlled, they may also be dependently controlled. Thus, for example, the color temperature of the lighting device may be established at the time of manufacture as described in U.S. Patent Application No. 60/990,724, filed on Nov. 28, 2007, entitled "SOLID STATE LIGHTING DEVICES AND METHODS OF MANUFACTURING THE SAME", U.S. Patent Application No. 61/041,404, filed on Apr. 1, 2008, and U.S. patent application Ser. No. 12/257,804, filed on Oct. 24, 2008 (now U.S. Patent Publication No. 2009/0160363), the entireties of which are hereby incorporated by reference. The circuit also includes a rectifier ("RECT"), a dimmer ("DIM") and a power factor controller ("PFC").

As is further illustrated in FIG. 6, the color temperature may be maintained by, for example, the light sensor 125 and/or the temperature sensor 126 providing information to the regulated power supply units (the LED PSU 127, the RO LED PSU 128 and the LWBSY LED PSU 129) so as to adjust the current/voltage applied to the LEDs (the LED PSU 127 adjusts the current/voltage supplied to the phosphor LEDs 122, the LED PSU 128 adjusts the current/voltage supplied to the RO LEDs 123 and the LED PSU 129 adjusts the current/voltage supplied to the LWBSY LEDs 124) to maintain or otherwise control a color point of the lighting device. Such sensing may compensate for variations in aging of the differing LEDs and/or variation in temperature response of the differing LEDs. Suitable sensing techniques are known to those of skill in the art and described in U.S. Patent Application No. 60/943,910, filed on Jun. 14, 2007, entitled "DEVICES AND METHODS FOR POWER CONVERSION FOR LIGHTING DEVICES WHICH INCLUDE SOLID STATE LIGHT EMITTERS", and U.S. patent application Ser. No. 12/117,280 (now U.S. Patent Publication No. 2008/0309255), filed May 8, 2008, the entireties of which are hereby incorporated by reference.

Figure 7:
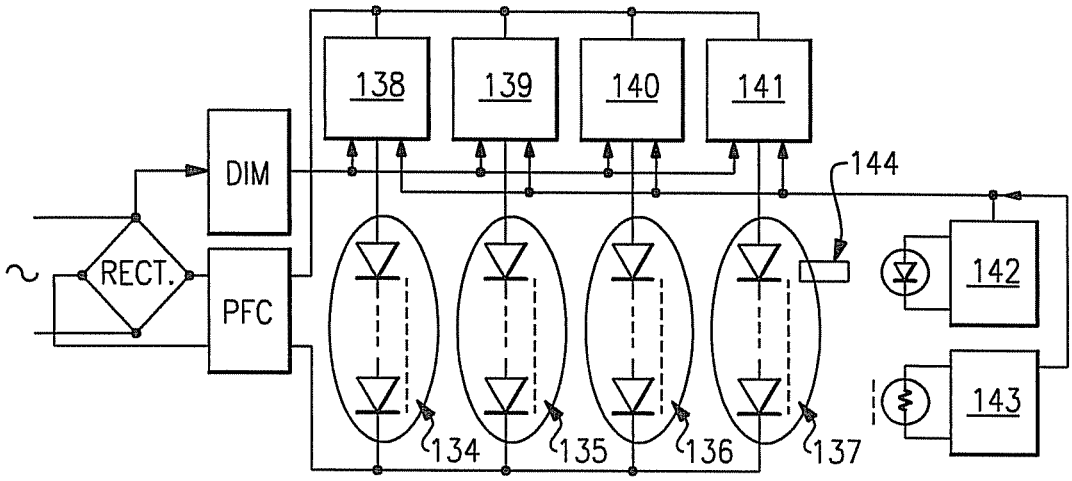
FIG. 7 is a schematic diagram of a luminaire incorporating further embodiments of the present inventive subject matter.

FIG. 7 is a schematic block diagram of the circuit of an embodiment of a lighting device according to the present inventive subject matter, similar to the embodiment shown in FIG. 6, but incorporating two types of phosphor LEDs (namely, more yellowish phosphor LEDs 134 and more blueish phosphor LEDs 135), along with RO LEDs 136 and LWBSY LEDs 137, which makes it possible to adjust the color temperature and maintain high CRI.

The expression "more yellowish" is used herein to refer to a hue (and/or a light emitter that emits light of a hue) that is closer to a yellow hue or a yellowish hue (e.g., greenish yellow, yellowish green, orangish yellow or yellowish orange on a color chart), i.e., a first hue that is more yellowish than a second hue would be somewhere along a tie line that extends from the second hue to a saturated yellow hue or a saturated yellowish hue. Analogously, the expression "more blueish" is used herein to refer to a hue that is closer to a blue hue or a blueish hue (e.g., greenish blue or blueish green on a color chart), i.e., a first hue that is more blueish than a second hue would be somewhere along a tie line that extends from the second hue to a saturated blue hue or a saturated blueish hue.

Each string of LEDs 134-137 has a corresponding PSU 138-141. Such an embodiment may be particularly well suited for use with the manufacturing methods discussed above with respect to U.S. Patent Application Ser. Nos. 60/990,724, 61/041,404 and Ser. No. 12/257,804. The more blueish phosphor LEDs and the more yellowish phosphor LEDs are used to precisely match the required phosphor LED color point. The embodiment shown in FIG. 7 also includes a light sensor 142 and a temperature sensor 143. Optionally, the embodiment shown in FIG. 7 can include an optical fiber or guide 144 for getting light from the LEDs to the light sensor 142.

Figure 8:
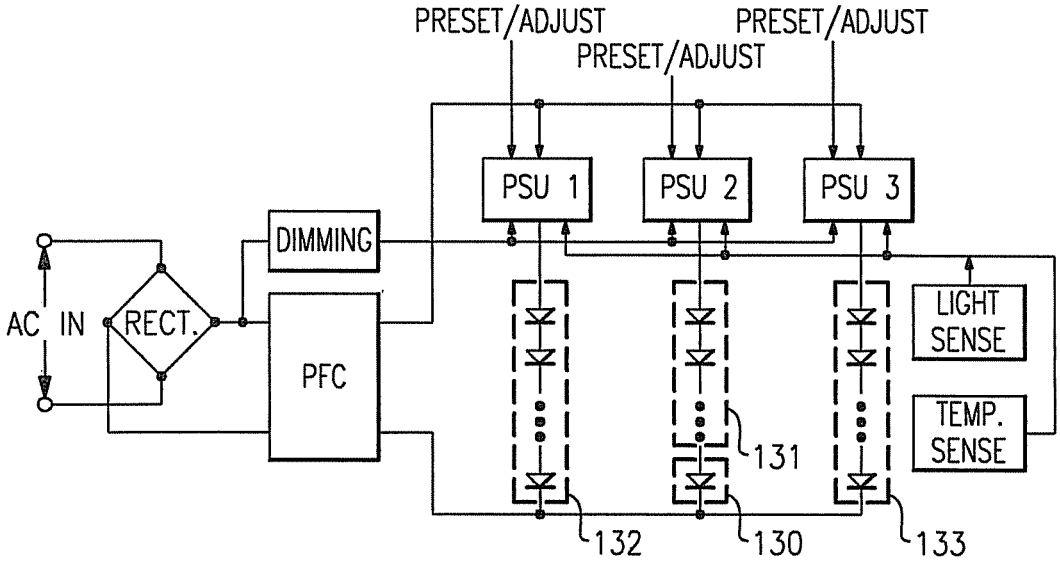
FIG. 8 is a schematic diagram of a luminaire combining a blue/cyan/green LED in a same string as a non-white phosphor LED according to further embodiments of the present inventive subject matter.

FIG. 8 is a schematic block diagram of a circuit for a lighting device incorporating some embodiments of the present inventive subject matter. As seen in FIG. 8, LWBSY LED(s) 130 may be included in a same string as one or more phosphor LEDs 131. In particular, two slightly different hue phosphor converted LEDs may be provided in separate strings, namely, more blueish phosphor LEDs 131 and more yellowish phosphor LEDs 132. The drive current through the two strings may be adjusted to set the overall color of the lighting device. The current through the two strings may be adjusted to move along a tie line between the color points of more yellowish phosphor LEDs and more blueish phosphor LEDs. The current through the RO LEDs may be adjusted to pull the combined color point of the phosphor LEDs to the proximity of the BBL.

In the embodiment illustrated in FIG. 8, the LWBSY LED(s) 130 may be added in series with or replace one or more of the phosphor converted LEDs 131 (and/or 132). Including the LWBSY LED(s) in a same string as the phosphor LEDs may simplify the power supply design, as only three drive units are needed. Accordingly, the methods of manufacture described in U.S. Application Ser. Nos. 60/990,724, 61/041,404 and Ser. No. 12/257,804 may be used with little or no modification.

In particular embodiments, the LWBSY LED(s) 130 replace one of the more blueish phosphor LEDs 131. Such a replacement of a blueish phosphor LED 131 may allow the same combination of color points of phosphor LEDs to be used to make 2700K lighting devices as makes 3500K lighting devices and the devices may all have a CRI Ra of 92 or greater and, in some cases 94 or greater.

For example, the phosphor LEDs may be selected from a first color bin having chromaticity region bounding coordinates of a CIE31 Chromaticity diagram of 0.3640, 0.4629; 0.3953, 0.4487; 0.3892, 0.438; and 0.3577, 0.4508 and a second color bin having chromaticity region bounding coordinates of a CIE31 Chromaticity diagram of 0.3577, 0.4508; 0.3892, 0.4380; 0.3845, 0.4296; and 0.3528, 0.4414. A first string of phosphor LEDs is provided from the first color bin and a second string of phosphor LEDs is provided from the second color bin. The second string has one fewer phosphor LEDs but an additional LWBSY LED with a dominant wavelength of the blue excitation LED in the range of from about 475 nm to about 480 nm. Alternatively, the LWBSY LED could replace one of the phosphor LEDs from the first string. As a further alternative, LWBSY LEDs could replace one phosphor LED in each of the two strings of phosphor LEDs. A third string of RO LEDs 133 with a dominant wavelength in the range of from about 615 nm to about 625 nm is also provided. Such a configuration may allow for controlling the current through the various LEDs so as to provide a lighting device with a color temperature of from about 2500K to about 4000K (in many cases from about 2700K to about 3500K) with a CRI Ra of greater than 92 and, in some cases, greater than 94. Furthermore, the color point of the lighting device may be within 7 MacAdam ellipses of the BBL and, in some embodiments, within 4 MacAdam ellipses of the BBL.

LWBSY LEDs may be selected from a third color bin having chromaticity region bounding coordinates of a CIE31 Chromaticity diagram of 0.335, 0.476; 0.328, 0.463; 0.358, 0.451; and 0.364, 0.463 or a fourth color bin having chromaticity region bounding coordinates of a CIE31 Chromaticity diagram of 0.328, 0.463; 0.322, 0.452; 0.353, 0.441; 0.358, 0.451.

In some embodiments, other phosphor LED color bins which provide a tie line that passes through the first color bin and the second color bin described above may be used. Likewise, other phosphor LED color bins which provide a tie line that passes through the third color bin and the fourth color bin described above may be used for the LWBSY LEDs.

In other embodiments where multiple LWBSY LED(s) are used, the LWBSY LEDs may replace an LED from each of the phosphor LED strings. Thus, a phosphor converted LED could be replaced by a LWBSY LED in each of the two phosphor LED strings. One example of such an embodiment may produce a lighting device having a color temperature of about 4000K and a CRI Ra of 92 or greater. In particular, the phosphor LEDs may be selected from a first color bin having chromaticity region bounding coordinates of a CIE31 Chromaticity diagram of 0.3426, 0.4219; 0.3747, 0.4122; 0.3696, 0.4031; and 0.3373, 0.4118 and a second color bin having chromaticity region bounding coordinates of a CIE31 Chromaticity diagram of 0.3373, 0.4118; 0.3696, 0.4031; 0.3643, 0.3937; and 0.3318, 0.4013. A first string of phosphor LEDs is provided from the first color bin and a second string of phosphor LEDs is provided from the second color bin. Each string has one LWBSY LED with a dominant wavelength of the excitation blue LED in the range of from about 475 nm to about 480 nm. A third string of RO LEDs with a dominant wavelength in the range of from about 615 nm to about 625 nm is also provided.

In some embodiments, one or more BSY LEDs can be selected from among the color bins set forth in Table 1 below, and one or more LW BSY LEDs can be selected from among the color bins set forth in Table 3 below:

TABLE 1

| Chromaticity Region Bounding Coordinates | | |
|---|---|---|
| Region | x | y |
| XA | 0.3697 | 0.4738 |
| | 0.4008 | 0.4584 |
| | 0.3953 | 0.4487 |
| | 0.3640 | 0.4629 |
| XB | 0.3640 | 0.4629 |
| | 0.3953 | 0.4487 |
| | 0.3892 | 0.438 |
| | 0.3577 | 0.4508 |
| XC | 0.3577 | 0.4508 |
| | 0.3892 | 0.4380 |
| | 0.3845 | 0.4296 |
| | 0.3528 | 0.4414 |
| XD | 0.3528 | 0.4414 |
| | 0.3845 | 0.4296 |
| | 0.3798 | 0.4212 |
| | 0.3479 | 0.4320 |
| XE | 0.3479 | 0.4320 |
| | 0.3798 | 0.4212 |
| | 0.3747 | 0.4122 |
| | 0.3426 | 0.4219 |
| XF | 0.3426 | 0.4219 |
| | 0.3747 | 0.4122 |
| | 0.3696 | 0.4031 |
| | 0.3373 | 0.4118 |
| XG | 0.3373 | 0.4118 |
| | 0.3696 | 0.4031 |
| | 0.3643 | 0.3937 |
| | 0.3318 | 0.4013 |
| XH | 0.3318 | 0.4013 |
| | 0.3643 | 0.3937 |
| | 0.3590 | 0.3843 |
| | 0.3263 | 0.3908 |
| XJ | 0.3263 | 0.3908 |
| | 0.3590 | 0.3843 |
| | 0.3543 | 0.3759 |
| | 0.3215 | 0.3815 |
| XK | 0.3215 | 0.3815 |
| | 0.3543 | 0.3759 |
| | 0.3496 | 0.3675 |
| | 0.3166 | 0.3722 |

TABLE 1-continued

| Chromaticity Region Bounding Coordinates | | |
|---|---|---|
| Region | x | y |
| XM | 0.3762 | 0.4863 |
| | 0.4070 | 0.4694 |
| | 0.4008 | 0.4584 |
| | 0.3697 | 0.4738 |
| XN | 0.3836 | 0.5004 |
| | 0.4140 | 0.4819 |
| | 0.4070 | 0.4694 |
| | 0.3762 | 0.4863 |
| XP | 0.3920 | 0.5164 |
| | 0.4219 | 0.4960 |
| | 0.4140 | 0.4819 |
| | 0.3836 | 0.5004 |

TABLE 3

| Chromaticity Region Bounding Coordinates | | |
|---|---|---|
| Region | x | y |
| YA | 0.343 | 0.488 |
| | 0.370 | 0.475 |
| | 0.335 | 0.476 |
| | 0.364 | 0.463 |
| YB | 0.335 | 0.476 |
| | 0.364 | 0.463 |
| | 0.328 | 0.463 |
| | 0.358 | 0.451 |
| YC | 0.328 | 0.463 |
| | 0.358 | 0.451 |
| | 0.323 | 0.453 |
| | 0.353 | 0.443 |
| YD | 0.323 | 0.453 |
| | 0.353 | 0.443 |
| | 0.318 | 0.441 |
| | 0.345 | 0.430 |
| YE | 0.318 | 0.441 |
| | 0.345 | 0.430 |
| | 0.313 | 0.432 |
| | 0.345 | 0.421 |
| YF | 0.313 | 0.432 |
| | 0.345 | 0.421 |
| | 0.307 | 0.421 |
| | 0.339 | 0.412 |
| YG | 0.307 | 0.421 |
| | 0.339 | 0.412 |
| | 0.302 | 0.410 |
| | 0.334 | 0.402 |
| YH | 0.302 | 0.410 |
| | 0.334 | 0.402 |
| | 0.296 | 0.401 |
| | 0.329 | 0.393 |
| YJ | 0.296 | 0.401 |
| | 0.329 | 0.393 |
| | 0.291 | 0.391 |
| | 0.324 | 0.384 |
| YK1 | 0.291 | 0.391 |
| | 0.324 | 0.384 |
| | 0.286 | 0.382 |
| | 0.319 | 0.376 |
| YK2 | 0.286 | 0.382 |
| | 0.319 | 0.376 |
| | 0.282 | 0.372 |
| | 0.316 | 0.369 |
| YM | 0.348 | 0.501 |
| | 0.373 | 0.486 |
| | 0.343 | 0.488 |
| | 0.370 | 0.475 |
| YN | 0.359 | 0.520 |
| | 0.383 | 0.500 |
| | 0.348 | 0.501 |
| | 0.373 | 0.486 |

In some embodiments, one or more light emitters (and/or a support member on which one or more light emitters are mounted) and/or one or more element containing one or more luminescent materials can be removable.

The term "removable", as used herein, means that the element (e.g., one or more solid state light emitter) that is characterized as being removable can be removed from the lighting device without structurally changing any component in the remainder of the lighting device, e.g., a light emitter can be removed from the lighting device and replaced with a replacement light emitter, without soldering, gluing, cutting, fracturing, etc., (and in some embodiments without the need for any tools) so that the lighting device with the replacement light emitter(s) is structurally substantially identical to the lighting device with the previous light emitter(s) except for the light emitter(s) (or, if the replacement light emitter(s) is substantially identical to the previous light emitter(s), the entirety of the lighting device with the replacement light emitter(s) is structurally substantially identical to the entirety of the lighting device with the previous light emitter(s)).

In embodiments in which one or more light emitters and/or one or more elements that comprise one or more luminescent materials is/are removable, various advantages may be attainable. For instance, by providing for the ability to replace such component(s), one or more light emitters can be operated at higher temperatures (even if such higher temperatures may reduce the life-expectancy of the light emitter(s), but that such light emitters) can be replaced, if necessary), which may make it possible to obtain greater lumen output from the lighting device (which can enable a reduction in initial equipment cost because fewer lighting devices are needed to provide a particular combined lumen output), and/or to reduce or even minimize heat dissipation transfer and/or dissipation structure(s) in the lighting device.

In some embodiments, light emitters may be arranged pursuant to a guideline described below in paragraphs (1)-(5), or any combination of two or more thereof, to further promote mixing of light from light emitters emitting different colors of light:

(1) an array that has groups of first and second light emitters with the first group of light emitters arranged so that no two of the first group light emitters are directly next to one another in the array;

(2) an array that comprises a first group of light emitters and one or more additional groups of light emitters, the first group of light emitters being arranged so that at least three light emitters from the one or more additional groups is adjacent to each of the light emitters in the first group;

(3) an array that comprises a first group of light emitters and one or more additional groups of light emitters, and the array is arranged so that less than fifty percent (50%), or as few as possible, of the light emitters in the first group of light emitters are on the perimeter of the array;

(4) an array that comprises a first group of light emitters and one or more additional groups of light emitters, and the first group of light emitters is arranged so that no two light emitters from the first group are directly next to one another in the array, and so that at least three light emitters from the one or more additional groups is adjacent to each of the light emitters in the first group; and/or (5) an array that is arranged so that no two light emitters from the first group are directly next to one another in the array, fewer than fifty percent (50%) of the light emitters in the first group of light emitters are on the perimeter of the array, and at least three light emitters from the one or more additional groups are adjacent to each of the light emitters in the first group.

Arrays according to the present inventive subject matter can also be arranged other ways, and can have additional features, that promote color mixing. In some embodiments, light emitters can be arranged so that they are tightly packed, which can further promote natural color mixing. The lighting device can also comprise different diffusers and reflectors to promote color mixing in the near field and in the far field.

In addition, light emitters can be spatially offset from one another and/or spatially arranged relative to each other as described in U.S. Provisional patent application Ser. No. 12/776,947, filed May 10, 2010 (now U.S. Patent Publication No. 2011/0182065), entitled "LIGHTING DEVICE WITII MULTI-CHIP LIGHT EMITTERS, SOLID STATE LIGHT EMITTER SUPPORT MEMBERS AND LIGHTING ELEMENTS", the entirety of which is hereby incorporated by reference as if set forth in its entirety.

Light emitters can be mounted on support members (or other structures) in any suitable way, e.g., by using chip on heat sink mounting techniques, by soldering (e.g., if a support member comprises a metal core printed circuit board (MCPCB), flex circuit or even a standard PCB, such as an FR4 board), for example, solid state light emitters can be mounted using substrate techniques such as from Thermastrate Ltd of Northumberland, UK. If desired, the surface of a support member and/or one or more light emitters can be machined or otherwise formed to be of matching topography so as to provide high heat sink surface area.

The following discussion of housing members applies to housing members that can be included in any of the lighting devices according to the present inventive subject matter.

A housing member (or one or more housing members) (if included) can be of any suitable shape and size, and can be made of any suitable material or materials. Persons of skill in the art are familiar with, and can envision, a wide variety of materials out of which a housing can be constructed (for example, a metal, a ceramic material, a plastic material with low thermal resistance, or combinations thereof), and a wide variety of shapes for such housings, and housings made of any of such materials and having any of such shapes can be employed in accordance with the present inventive subject matter. In some embodiments, particularly where a housing member provides or assists in providing heat transfer and/or heat dissipation, the housing member can be formed of spun aluminum, stamped aluminum, die cast aluminum, powder metallurgy formed aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (PMMA) sheet, cast or injection molded acrylic, thermoset bulk molded compound or other composite material, aluminum nitride (AlN), silicon carbide (SiC), diamond, diamond-like carbon (DLC), metal alloys, and polymers mixed with ceramic or metal or metalloid particles.

One or more housing members can be provided in order to support and/or protect any of the components (or combinations of components) of the lighting devices according to the present inventive subject matter as described herein.

In some embodiments, a housing member (or one or more housing members) can comprise one or more heat dissipation regions, e.g., one or more heat dissipation fins and/or one or more heat dissipation pins, or any other structure that provides or enhances any suitable thermal management scheme.

In embodiments that comprise a light emitter support member, the support member (or at least one of plural support members) can facilitate the transfer of heat to a heat dissipation structure (or structures) and/or can function as a heat sink and/or as a heat dissipation structure.

In some embodiments, which can include or not include, as suitable, any of the other features described herein, any component (or components) of a lighting device can comprise one or more heat dissipation structures, e.g., fins or pins.

Some embodiments of lighting devices according to the present inventive subject matter may have only passive cooling. On the other hand, some embodiments of lighting devices according to the present inventive subject matter can have active cooling (and can optionally also have one or more passive cooling features). The expression "active cooling" is used herein in a manner that is consistent with its common usage to refer to cooling that is achieved through the use of some form of energy, as opposed to "passive cooling", which is achieved without the use of energy (i.e., while energy is supplied to light emitters, passive cooling is the cooling that would be achieved without the use of any component(s) that would require additional energy in order to function to provide additional cooling). In some embodiments of the present inventive subject matter, therefore, cooling is achieved with only passive cooling, while in other embodiments of the present inventive subject matter, active cooling is provided (and any of the features described herein that provide or enhance passive cooling can optionally be included).

In some embodiments, a housing member (or one or more housing members) and a mixing chamber element are integral.

In some embodiments, one or more housing members is/are shaped so that it/they can accommodate one or more light emitters, and/or any of a variety of components or modules involved, e.g., in receiving current supplied to a lighting device, modifying the current (e.g., converting it from AC to DC and/or from one voltage to another voltage), and/or driving one or more light emitters (e.g., illuminating one or more light emitter intermittently and/or adjusting the current supplied to one or more light emitters in response to a detected operating temperature of one or more light emitter, a detected change in intensity or color of light output, a detected change in an ambient characteristic such as temperature or background light, a user command, etc., and/or a signal contained in the input power, such as a dimming signal in AC power supplied to the lighting device).

In some embodiments, which can include or not include, as suitable, any of the other features described herein, lighting devices (or lighting device elements) according to the present inventive subject matter can include any suitable thermal management solutions.

Lighting devices (and lighting device elements) according to the present inventive subject matter can employ any suitable heat dissipation scheme, a wide variety of which (e.g., one or more heat dissipation structures) are well known to persons skilled in the art and/or which can readily be envisioned by persons skilled in the art. Representative examples of heat dissipation schemes which might be suitable are described in:

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 12/411,905, filed on Mar. 26, 2009 (now U.S. Patent Publication No. 2010/0246177), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/469,828, filed on May 21, 2009 (now U.S. Patent Publication No. 2010/0103678), the entirety of which is hereby incorporated by reference as if set forth in its entirety;

U.S. patent application Ser. No. 12/551,921, filed on Sep. 1, 2009 (now U.S. Patent Publication No. 2011/0050070), the entirety of which is hereby incorporated by reference as if set forth in its entirety;

U.S. Patent Application No. 61/245,683, filed on Sep. 25, 2009 , the entirety of which is hereby incorporated by reference as if set forth in its entirety;

U.S. Patent Application No. 61/245,685, filed on Sep. 25, 2009 , the entirety of which is hereby incorporated by reference as if set forth in its entirety;

U.S. patent application Ser. No. 12/566,850, filed on Sep. 25, 2009 (now U.S. Patent Publication No. 2011/0074265) , the entirety of which is hereby incorporated by reference as if set forth in its entirety;

U.S. patent application Ser. No. 12/582,206, filed on Oct. 20, 2009(now U.S. Patent Publication No. 2011/0090686), the entirety of which is hereby incorporated by reference as if set forth in its entirety;

U.S. patent application Ser. No. 12/607,355, filed on Oct. 28, 2009(now U.S. Patent Publication No. 2011/0089838), the entirety of which is hereby incorporated by reference as if set forth in its entirety; and U.S. patent application Ser. No. 12/683,886, filed on Jan. 7, 2010(now U.S. Patent Publication No. 2011/0089830), the entirety of which is hereby incorporated by reference as if set forth in its entirety.

In embodiments where active cooling is provided, any type of active cooling can be employed, e.g., blowing or pushing (or assisting in blowing) an ambient fluid (such as air) across or near one or more heat dissipation elements or heat sinks, thermoelectric cooling, phase change cooling (including supplying energy for pumping and/or compressing fluid), liquid cooling (including supplying energy for pumping, e.g., water, liquid nitrogen or liquid helium), magnetoresistance, etc.

In some embodiments, which can include or not include, as suitable, any of the other features described herein, one or more heat spreaders can be provided in order to move heat away from one or more support members to one or more heat sink regions and/or one or more heat dissipation regions, and/or the heat spreader can itself provide surface area from which heat can be dissipated. Persons of skill in the art are familiar with a variety of materials that would be suitable for use in making a heat spreader, and any of such materials (e.g., copper, aluminum, etc.) can be employed.

In some embodiments, which can include or not include, as suitable, any of the other features described herein, a heat spreader can be provided that is in contact with a first surface of a support member, and one or more light emitters can be mounted on a second surface of the support member, the first surface and the second surface being on opposite sides of the support member. In such embodiments, if desired, circuitry (e.g., a compensation circuit) can be provided and positioned in contact with such a heat spreader, e.g., a heat spreader can be located between a support member and a compensation circuit, and/or a heat spreader can have a recess that opens to a surface of the heat spreader that is remote from a support member, and a compensation circuit can be located within that recess.

Heat transfer from one structure or region of a lighting device (or lighting device element) to another can be enhanced (i.e., thermal resistivity can be reduced or minimized) using any suitable material or structure for doing so, a variety of which are known to persons of skill in the art, e.g., by means of chemical or physical bonding and/or by interposing a heat transfer aid such as a thermal pad, thermal grease, graphite sheets, etc.

In some embodiments according to the present inventive subject matter, a portion (or portions) of any module, element, or other component of a lighting device can comprise one or more thermal transfer region(s) that has/have an elevated heat conductivity (e.g., higher than the rest of that module, element or other component. A thermal transfer region (or regions) can be made of any suitable material, and can be of any suitable shape. Use of materials having higher heat conductivity in making the thermal transfer region(s) generally provides greater heat transfer, and use of thermal transfer region(s) of larger surface area and/or cross-sectional area generally provides greater heat transfer. Representative examples of materials that can be used to make the thermal transfer region(s), if provided, include metals, diamond, DLC, etc. Representative examples of shapes in which the thermal transfer region(s), if provided, can be formed include bars, slivers, slices, crossbars, wires and/or wire patterns. A thermal transfer region (or regions), if included, can also function as one or more pathways for carrying electricity, if desired.

In some embodiments, which can include or not include, as suitable, any of the other features described herein, a sensor (e.g., a temperature sensor, such as a thermistor) can be positioned in any suitable location, e.g., a temperature sensor (e.g., a thermistor) can be positioned in contact with a heat spreader, e.g., between the heat spreader and a compensation circuit).

Lighting devices or lighting device elements according to the present inventive subject matter can comprise one or more electrical connectors.

Various types of electrical connectors are well known to those skilled in the art, and any of such electrical connectors can be attached within (or attached to) the lighting devices according to the present inventive subject matter. Representative examples of suitable types of electrical connectors include wires (for splicing to a branch circuit), Edison plugs (i.e., Edison screw threads, which are receivable in Edison sockets) and GU24 pins (which are receivable in GU24 sockets). Other well known types of electrical connectors include 2-pin (round) GX5.3, can DC bay, 2-pin GY6.35, recessed single contact R7s, screw terminals, 4 inch leads, 1 inch ribbon leads, 6 inch flex leads, 2-pin GU4, 2-pin GU5.3, 2-pin G4, turn & lock GU7, GU10, G8, G9, 2-pin Pf, min screw E10, DC bay BA15d, min cand E11, med screw E26, mog screw E39, mogul bipost G38, ext. mog end pr GX16d, mod end pr GX16d and med skirted E26/50×39 (see https://www.gecatalogs.com/lighting/software/GELightingCatalogSetup.exe). In some embodiments, an electrical connector can be attached to at least one housing member.

An electrical connector, if included, can be electrically connected to one or more circuitry component, e.g., a power supply, an electrical contact region or element, and/or a circuit board (on which a plurality of light emitters are mounted).

It would be especially desirable to provide a lighting device that comprises one or more light emitters (and in which some or all of the light produced by the lighting device is generated by light emitters), where the lighting device can be easily substituted (i.e., retrofitted or used in place of initially) for a conventional lighting device (e.g., an incandescent lighting device, a fluorescent lighting device or other conventional types of lighting devices), for example, a lighting device (that comprises one or more solid state light emitters) that can be engaged with the same socket that the conventional lighting device is engaged (a representative example being simply unscrewing an incandescent lighting device from an Edison socket and threading in the Edison socket, in place of the incandescent lighting device, a lighting device that comprises one or more solid state light emitters). In some aspects of the present inventive subject matter, such lighting devices are provided.

Some embodiments in accordance with the present inventive subject matter (which can include or not include any of the features described elsewhere herein) include one or more lenses, diffusers or light control elements. Persons of skill in the art are familiar with a wide variety of lenses, diffusers and light control elements, can readily envision a variety of materials out of which a lens, a diffuser, or a light control element can be made (e.g., polycarbonate materials, acrylic materials, fused silica, polystyrene, etc.), and are familiar with and/or can envision a wide variety of shapes that lenses, diffusers and light control elements can be. Any of such materials and/or shapes can be employed in a lens and/or a diffuser and/or a light control element in an embodiment that includes a lens and/or a diffuser and/or a light control element. As will be understood by persons skilled in the art, a lens or a diffuser or a light control element in a lighting device according to the present inventive subject matter can be selected to have any desired effect on incident light (or no effect), such as focusing, diffusing, altering the direction of emission from the lighting device (e.g., increasing the range of directions that light proceeds from the lighting device, such as bending light to travel below the emission plane of the light emitters. Any such lens and/or diffuser and/or light control element can comprise one or more luminescent materials, e.g., one or more phosphor.

Representative examples of lenses that can be employed in accordance with the present inventive subject matter include total internal reflection (TIR) optics (e.g., available from Fraen SRL (www.fraensrl.com)). As is well know, in some instances, TIR optics comprise solid shapes (e.g., generally cone-shaped), formed of any suitable material or materials (e.g., clear acrylic material) designed to receive light at one end (e.g., at a rounded point of the cone), provide total internal reflection of a large portion of light that hits its sidewalls, and to collimate the light before it exits from the generally circular portion of the cone, where, if desired, as is well known, one or more lenslets can be provided to diffuse the light to some extent.

In embodiments in accordance with the present inventive subject matter that include a lens (or plural lenses), the lens (or lenses) can be positioned in any suitable location and orientation.

In embodiments in accordance with the present inventive subject matter that include a diffuser (or plural diffusers), the diffuser (or diffusers) can be positioned in any suitable location and orientation. In some embodiments, which can include or not include any of the features described elsewhere herein, a diffuser can be provided over a top or any other part of the lighting device. A diffuser can be included in the form of a diffuser film/layer that is arranged to mix light emission from light emitters in the near field. That is, a diffuser can mix the emission of light emitters, such that when the lighting device is viewed directly, the light from the discrete light emitters is not separately identifiable.

A diffuser film (if employed) can comprise any of many different structures and materials arranged in different ways, e.g., it can comprise a conformally arranged coating over a lens. In some embodiments, commercially available diffuser films can be used such as those provided by Bright View Technologies, Inc. of Morrisville, N.C., Fusion Optix, Inc. of Cambridge, Mass., or Luminit, Inc. of Torrance, Calif. Some of these films can comprise diffusing microstructures that can comprise random or ordered micro lenses or geometric features and can have various shapes and sizes. A diffuser film can be sized to fit over all or less than all of a lens, and can be bonded in place over a lens using known bonding materials and methods. For example, a film can be mounted to a lens with an adhesive, or could be film insert molded with a lens. In other embodiments, a diffuser film can comprise scattering particles, or can comprise index photonic features, alone or in combination with microstructures. A diffuser film can have any of a wide range of suitable thicknesses (some diffuser films are commercially available in a thickness in the range of from 0.005 inches to 0.125 inches, although films with other thicknesses can also be used).

In other embodiments, a diffuser and/or scattering pattern can be directly patterned onto a component, e.g., a lens. Such a pattern may, for example, be random or a pseudo pattern of surface elements that scatter or disperse light passing through them. The diffuser can also comprise microstructures within the component (e.g., lens), or a diffuser film can be included within the component (e.g., lens).

Diffusion and/or light scattering can also be provided or enhanced through the use of additives, a wide variety of which are well known to persons of skill in the art. Any of such additives can be contained in a lumiphor, in an encapsulant, and/or in any other suitable element or component of the lighting device.

In embodiments in accordance with the present inventive subject matter that include a light control element (or plural light control elements), the light control element (or light control elements) can be positioned in any suitable location and orientation. Persons of skill in the art are familiar with a variety of light control elements, and any of such light control elements can be employed. For example, representative light control elements are described in U.S. Patent Application No. 61/245,688, filed on Sep. 25, 2009 , the entirety of which is hereby incorporated by reference as if set forth in its entirety. A light control element (or elements) can be any structure or feature that alters the overall nature of a pattern formed by light emitted by a light source. As such, the expression "light control element", as used herein, encompasses, e.g., films and lenses that comprise one or more volumetric light control structures and/or one or more surface light control features.

In addition, one or more scattering elements (e.g., layers) can optionally be included in the lighting devices according to the present inventive subject matter. For example, a scattering element can be included in a lumiphor (i.e., a transparent or translucent article in which luminescent material is embedded), and/or a separate scattering element can be provided. A wide variety of separate scattering elements are well known to those of skill in the art, and any such elements can be employed in the lighting devices of the present inventive subject matter. Scattering elements can be made from different materials, such as particles of titanium dioxide, alumina, silicon carbide, gallium nitride, or glass micro spheres, e.g., with the particles dispersed within a lens.

Persons of skill in the art are familiar with, and have ready access to, a wide variety of filters, and any suitable filter (or filters), or combinations of different types of filters, can be employed in accordance with the present inventive subject matter. Such filters can include (1) pass-through filters, i.e., filters in which light to be filtered is directed toward the filter, and some or all of the light passes through the filter (e.g., some of the light does not pass through the filter) and the light that passes through the filter is the filtered light, (2) reflection filters, i.e., filters in which light to be filtered is directed toward the filter, and some or all of the light is reflected by the filter (e.g., some of the light is not reflected by the filter) and the light that is reflected by the filter is the filtered light, and (3) filters that provide a combination of both pass-through filtering and reflection filtering.

Any desired circuitry, including any desired electronic components, can be employed in order to supply energy to one or more light emitters according to the present inventive subject matter. Representative examples of circuitry which may be used in practicing the present inventive subject matter are described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety; and U.S. patent application Ser. No. 12/328,115, filed on Dec. 4, 2008 (now U.S. Patent Publication No. 2009-0184662), the entirety of which is hereby incorporated by reference as if set forth in its entirety.

U.S. patent application Ser. No. 12/566,142, filed on Sep. 24, 2009, entitled "Solid State Lighting Apparatus With Configurable Shunts" (now U.S. Patent Publication No. 2011/0068696), the entirety of which is hereby incorporated by reference as if set forth in its entirety;

U.S. patent application Ser. No. 12/566,195, filed on Sep. 24, 2009, entitled "Solid State Lighting Apparatus With Controllable Bypass Circuits And Methods Of Operation Thereof", now U.S. Patent Publication No. 2011/0068702), the entirety of which is hereby incorporated by reference as if set forth in its entirety.

For example, solid state lighting systems have been developed that include a power supply that receives AC line voltage and converts that voltage to a voltage (e.g., to DC and to a different voltage value) and/or current suitable for driving light emitters. Power supplies for light emitting diode light sources can include any of a wide variety of electrical components, e.g., linear current regulated supplies and/or pulse width modulated current and/or voltage regulated supplies, and can include bridge rectifiers, transformers, power factor controllers etc.

Many different techniques have been described for driving solid state light sources in many different applications, including, for example, those described in U.S. Pat. No.

3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Berg Johansen, U.S. Pat. No. 7,202,608 to Robinson et al, U.S. Pat. No. 6,995,518, U.S. Pat. No. 6,724,376, U.S. Pat. No. 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

Various electronic components (if provided in the lighting devices) can be mounted in any suitable way. For example, in some embodiments, light emitting diodes can be mounted on one or more support members, and electronic circuitry that can convert AC line voltage into DC voltage suitable for being supplied to light emitting diodes can be mounted on a separate element (e.g., a "driver circuit board"), whereby line voltage is supplied to the electrical connector and passed along to a driver circuit board, the line voltage is converted to DC voltage suitable for being supplied to light emitting diodes in the driver circuit board, and the DC voltage is passed along to the support member (or members) where it is then supplied to the light emitting diodes.

In some embodiments according to the present inventive subject matter, the lighting device is a self-ballasted device. For example, in some embodiments, the lighting device can be directly connected to AC current (e.g., by being plugged into a wall receptacle, by being screwed into an Edison socket, by being hard-wired into a branch circuit, etc.). Representative examples of self-ballasted devices are described in U.S. patent application Ser. No. 11/947,392, filed on Nov. 29, 2007 (now U.S. Patent Publication No. 2008/0130298), the entirety of which is hereby incorporated by reference as if set forth in its entirety.

Compensation circuits can be provided to help to ensure that the perceived color (including color temperature in the case of "white" light) of light exiting a lighting device is accurate (e.g., within a specific tolerance). Such compensation circuits, if included, can (for example) adjust the current supplied to light emitters that emit light of one color and/or separately adjust the current supplied to light emitters that emit light of a different color, so as to adjust the color of mixed light emitted from lighting devices, and such adjustment(s) can be (1) based on temperature sensed by one or more temperature sensors (if included), and/or (2) based on light emission as sensed by one or more light sensors (if included) (e.g., based on one or more sensors that detect (i) the color of the light being emitted from the lighting device, and/or (ii) the intensity of the light being emitted from one or more of the light emitters, and/or (iii) the intensity of light of one or more specific hues of color), and/or based on any other sensors (if included), factors, phenomena, etc.

A wide variety of compensation circuits are known, and any can be employed in the lighting devices according to the present inventive subject matter. For example, a compensation circuit may comprise a digital controller, an analog controller or a combination of digital and analog. For example, a compensation circuit may comprise an application specific integrated circuit (ASIC), a microprocessor, a microcontroller, a collection of discrete components or combinations thereof. In some embodiments, a compensation circuit may be programmed to control one or more light emitters. In some embodiments, control of one or more light emitters may be provided by the circuit design of the compensation circuit and is, therefore, fixed at the time of manufacture. In still further embodiments, aspects of the compensation circuit, such as reference voltages, resistance values or the like, may be set at the time of manufacture so as to allow adjustment of the control of the one or more light emitters without the need for programming or control code.

Representative examples of suitable compensation circuits are described in:

U.S. patent application Ser. No. 11/755,149, filed May 30, 2007 (now U.S. Patent Publication No. 2007/0278974), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/257,804, filed on Oct. 24, 2008 (now U.S. Patent Publication No. 2009/0160363), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety;

U.S. patent application Ser. No. 12/566,195, filed on Sep. 24, 2009, entitled "Solid State Lighting Apparatus With Controllable Bypass Circuits And Methods Of Operation Thereof", now U.S. Patent Publication No. 2011/0068702), the entirety of which is hereby incorporated by reference as if set forth in its entirety;

U.S. patent application Ser. No. 12/704,730, filed on Feb. 12, 2010, entitled "Solid State Lighting Apparatus With Compensation Bypass Circuits And Methods Of Operation Thereof", now U.S. Patent Publication No. 2011/0068701), the entirety of which is hereby incorporated by reference as if set forth in its entirety;

U.S. patent application Ser. No. 12/704,995, filed on Feb. 12, 2010 (now U.S. Patent Publication No. 2011/0198984), the entirety of which is hereby incorporated by reference as if set forth in its entirety; and U.S. patent application Ser. No. 61/312,918, filed on Mar. 11, 2010 , the entirety of which is hereby incorporated by reference as if set forth in its entirety.

The following discussion of color sensors applies to color sensors that can be included in any of the lighting devices according to the present inventive subject matter.

Persons of skill in the art are familiar with a wide variety of color sensors, and any of such sensors can be employed in the lighting devices of the present inventive subject matter. Among these well known sensors are sensors that are sensitive to all visible light, as well as sensors that are sensitive to only a portion of visible light. For example, the sensor can be a unique and inexpensive sensor (GaP:N light emitting diode) that views the entire light flux but is only (optically) sensitive to one or more of a plurality of light emitting diodes. For instance, in one specific example, the sensor can be sensitive to only a particular range (or ranges) of wavelengths, and the sensor can provide feedback to one or more light sources (e.g., light emitting diodes that emit light of that color or that emit light of other colors) for color consistency as the light sources age (and light output decreases). By using a sensor that monitors output selectively (by color), the output of one color can be selectively controlled to maintain the proper ratios of outputs and thereby maintain the color output of the device. This type of sensor is excited by only light having wavelengths within a particular range, e.g., a range that excludes red light (see, e.g., U.S. patent application Ser. No. 12/117,280, filed May 8, 2008 (now U.S. Patent Publication No. 2008/0309255), the entirety of which is hereby incorporated by reference as if set forth in its entirety.

Other techniques for sensing changes in light output of light sources include providing separate or reference emitters and a sensor that measures the light output of these emitters. These reference emitters can be placed so as to be isolated from ambient light such that they typically do not contribute to the light output of the lighting device. Additional techniques for sensing the light output of a light source include measuring ambient light and light output of the lighting device separately and then compensating the measured light output of the light source based on the measured ambient light.

The following discussion of temperature sensors applies to temperature sensors that can be included in any of the lighting devices according to the present inventive subject matter.

Some embodiments in accordance with the present inventive subject matter can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to compensation circuitry, e.g., to current adjusters, as described in U.S. patent application Ser. No. 12/117,280, filed May 8, 2008 (now U.S. Patent Publication No. 2008/0309255), the entirety of which is hereby incorporated by reference as if set forth in its entirety.

In some embodiments, one or more temperature sensors (e.g., a single temperature sensor or a network of temperature sensors) can be provided which are in contact with one or more light emitters (or on the surface of a support member on which one or more light emitters are mounted), or are positioned close to one or more light emitters (e.g., less than ¼ inch away), such that the temperature sensor(s) provide accurate readings of the temperature of the light emitter(s).

In some embodiments, one or more temperature sensors (e.g., a single temperature sensor or a network of temperature sensors) can be provided which are not in contact with one or more light emitters, and are not positioned close to one or more light emitters, but are positioned such that it (or they) is spaced from the light emitter (or light emitters) by only structure (or structures) having low thermal resistance, such that the temperature sensor(s) provide accurate readings of the temperature of the light emitter(s).

In some embodiments, one or more temperature sensors (e.g., a single temperature sensor or a network of temperature sensors) can be provided which are not in contact with one or more light emitters, and are not positioned close to one or more light emitters, but the arrangement is such that the temperature at the temperature sensor(s) is proportional to the temperature at the light emitter(s), or the temperature at the temperature sensor(s) varies in proportion to the variance of temperature at the light emitter(s), or the temperature at the temperature sensor(s) is correlatable to the temperature at the light emitter(s).

Some embodiments in accordance with the present inventive subject matter can comprise a power line that can be connected to a source of power (such as a branch circuit, an electrical outlet, a battery, a photovoltaic collector, etc.) and that can supply power to an electrical connector (or directly to an electrical contact, e.g., the power line itself can be an electrical connector). Persons of skill in the art are familiar with, and have ready access to, a variety of structures that can be used as a power line. A power line can be any structure that can carry electrical energy and supply it to an electrical connector on a lighting device and/or to a lighting device according to the present inventive subject matter.

Energy can be supplied to the lighting devices according to the present inventive subject matter from any source or combination of sources, for example, the grid (e.g., line voltage), one or more batteries, one or more photovoltaic energy collection devices (i.e., a device that includes one or more photovoltaic cells that convert energy from the sun into electrical energy), one or more windmills, etc.

Lighting devices according to the present inventive subject matter can comprise one or more mixing chamber elements, one or more trim elements and/or one or more fixture elements.

A mixing chamber element (if included) can be of any suitable shape and size, and can be made of any suitable material or materials. Light emitted by one or more light emitters can be mixed to a suitable extent in a mixing chamber before exiting the lighting device.

Representative examples of materials that can be used for making a mixing chamber element include, among a wide variety of other materials, spun aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (PMMA) sheet, cast or injection molded acrylic, thermoset bulk molded compound or other composite material. In some embodiments, a mixing chamber element can consist of or can comprise a reflective element (and/or one or more of its surfaces can be reflective). Such reflective elements (and surfaces) are well-known and readily available to persons skilled in the art. A representative example of a suitable material out of which a reflective element can be made is a material marketed by Furukawa (a Japanese corporation) under the trademark MCPET®.

In some embodiments, a mixing chamber is defined (at least in part) by a mixing chamber element. In some embodiments, a mixing chamber is defined in part by a mixing chamber element (and/or by a trim element) and in part by a lens and/or a diffuser.

In some embodiments, at least one trim element can be attached to a lighting device according to the present inventive subject matter. A trim element (if included) can be of any suitable shape and size, and can be made of any suitable material or materials. Representative examples of materials that can be used for making a trim element include, among a wide variety of other materials, spun aluminum, stamped aluminum, die cast aluminum, rolled or stamped steel, hydroformed aluminum, injection molded metal, iron, injection molded thermoplastic, compression molded or injection molded thermoset, glass (e.g., molded glass), ceramic, liquid crystal polymer, polyphenylene sulfide (PPS), clear or tinted acrylic (PMMA) sheet, cast or injection molded acrylic, thermoset bulk molded compound or other composite material. In some embodiments that include a trim element, the trim element can consist of or can comprise a reflective element (and/or one or more of its surfaces can be reflective). Such reflective elements (and surfaces) are well known and readily available to persons skilled in the art. A representative example of a suitable material out of which a reflective element can be made is a material marketed by Furukawa (a Japanese corporation) under the trademark MCPET®.

In some embodiments according to the present inventive subject matter, a mixing chamber element can be provided which comprises a trim element (e.g., a single structure can be provided which acts as a mixing chamber element and as a trim element, a mixing chamber element can be integral with a trim element, and/or a mixing chamber element can comprise a region that functions as a trim element). In some embodiments, such structure can also comprise some or all of a thermal management system for the lighting device. By providing such a structure, it is possible to reduce or minimize the thermal interfaces between the light emitter(s) and the ambient environment (and thereby improve heat transfer), especially, in some cases, in devices in which a trim element acts as a heat sink for light source(s) (e.g., solid state light emitters) and is exposed to a room. In addition, such a structure can eliminate one or more assembly steps, and/or reduce parts count. In such lighting devices, the structure (i.e., the combined mixing chamber element and trim element) can further comprise one or more reflector and/or reflective film, with the structural aspects of the mixing chamber element being provided by the combined mixing chamber element and trim element).

In some embodiments, a lighting device (or lighting device element) according to the present inventive subject matter can be attached to at least one fixture element. A fixture element, when included, can comprise a fixture housing, a mounting structure, an enclosing structure, and/or any other suitable structure. Persons of skill in the art are familiar with, and can envision, a wide variety of materials out of which such fixture elements can be constructed, and a wide variety of shapes for such fixture elements. Fixture elements made of any of such materials and having any of such shapes can be employed in accordance with the present inventive subject matter.

For example, fixture elements, and components or aspects thereof, that may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" , the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957) , the entirety of which is hereby incorporated by reference as if set forth in its entirety;

U.S. patent application Ser. No. 12/467,467, filed on May 18, 2009 (now U.S. Patent Publication No. 2010/0290222), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/465,203 May 13, 2009, filed on May 13, 2009 (now U.S. Patent Publication No. 2010/0290208), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety;

U.S. patent application Ser. No. 12/469,828, filed on May 21, 2009 (now U.S. Patent Publication No. 2010/0103678), the entirety of which is hereby incorporated by reference as if set forth in its entirety;

U.S. patent application Ser. No. 12/566,936, filed on Sep. 25, 2009 (now U.S. Patent Publication No. 2011/0075423), the entirety of which is hereby incorporated by reference as if set forth in its entirety;

U.S. patent application Ser. No. 12/566,857, filed on Sep. 25, 2009 (now U.S. Patent Publication No. 2011/0075411), the entirety of which is hereby incorporated by reference as if set forth in its entirety;

U.S. patent application Ser. No. 12/621,970, filed on Nov. 19, 2009 (now U.S. Patent Publication No. 2011/0075414), the entirety of which is hereby incorporated by reference as if set forth in its entirety; and U.S. patent application Ser. No. 12/566,861, filed on Sep. 25, 2009 (now U.S. Patent Publication No. 2011/0075422), the entirety of which is hereby incorporated by reference as if set forth in its entirety.

In some embodiments, a fixture element, if provided, can further comprise an electrical connector that engages an electrical connector on the lighting device or that is electrically connected to the lighting device.

In some embodiments that include a fixture element, an electrical connector is provided that is substantially non-moving relative to the fixture element, e.g., the force normally employed when installing an Edison plug in an Edison socket does not cause the Edison socket to move more than one centimeter relative to the fixture element, and in some embodiments, not more than ½ centimeter (or not more than ¼ centimeter, or not more than one millimeter, etc.). In some embodiments, an electrical connector that engages an electrical connector on the lighting device can move relative to a fixture element, and structure can be provided to limit movement of the lighting device relative to the fixture element (e.g., as disclosed in U.S. patent application Ser. No. 11/877,038, filed Oct. 23, 2007 (now U.S. Patent Publication No. 2008/0106907), the entirety of which is hereby incorporated by reference as if set forth in its entirety).

In some embodiments, one or more structures can be attached to a lighting device that engage structure in a fixture element to hold the lighting device in place relative to the fixture element. In some embodiments, the lighting device can be biased against a fixture element, e.g., so that a flange portion of a trim element is maintained in contact (and forced against) a bottom region of a fixture element (e.g., a circular extremity of a cylindrical can light housing). Additional examples of structures that can be used to hold a lighting device in place relative to a fixture element are disclosed in U.S. patent application Ser. No. 11/877,038, filed Oct. 23, 2007 (now U.S. Patent Publication No. 2008/0106907), the entirety of which is hereby incorporated by reference as if set forth in its entirety).

The lighting devices of the present inventive subject matter can be arranged in generally any suitable orientation, a variety of which are well known to persons skilled in the art. For example, the lighting device can be a back-reflecting device or a front-emitting device.

Lighting devices according to the present inventive subject matter can be of any desired overall shape and size. In some embodiments, the lighting devices according to the present inventive subject matter are of size and shape (i.e., form factor) that correspond to any of the wide variety of light sources in existence, e.g., PAR lamps (e.g., PAR 30 lamps or PAR 38 lamps), A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, T lamps, Linestra 2-base lamps, AR lamps, ED lamps, E lamps, BT lamps, Linear fluorescent lamps, U-shape fluorescent lamps, circline fluorescent lamps, single twin tube compact fluorescent lamps, double twin tube compact fluorescent lamps, triple twin tube compact fluorescent lamps, A-line compact fluorescent lamps, screw twist compact fluorescent lamps, globe screw base compact fluorescent lamps, reflector screw base compact fluorescent lamps, etc. Within each of the lamp types identified in the previous sentence, numerous different varieties (or an infinite number of varieties) exist. For example, a number of different varieties of conventional A lamps exist and include those identified as A 15 lamps, A 17 lamps, A 19 lamps, A 21 lamps and A 23 lamps. The expression "A lamp" as used herein includes any lamp that satisfies the dimensional characteristics for A lamps as defined in ANSI C78.20-2003, including the conventional A lamps identified in the preceding sentence. Some representative examples of form factors include mini Multi-Mirror® projection lamps, Multi-Mirror® projection lamps, reflector projection lamps, 2-pin-vented base reflector projection lamps, 4-pin base CBA projection lamps, 4-pin base BCK projection lamps, DAT/DAK DAY/DAK incandescent projection lamps, DEK/DFW/DHN incandescent projection lamps, CAR incandescent projection lamps CAZ/CZB incandescent projection lamps, CZX/DAB incandescent projection lamps, DDB incandescent projection lamps, DRB DRC incandescent projection lamps, DRS incandescent projection lamps, BLX BLC BNF incandescent projection lamps, CDD incandescent projection lamps, CRX/CBS incandescent projection lamps, BAH BBA BCA ECA standard photofloods, EBW ECT standard photofloods, EXV EXX EZK reflector photofloods, DXC EAL reflector photofloods, double-ended projection lamps, G-6 G5.3 projection lamps, G-7 G29.5 projection lamps, G-7 2 button projection lamps, T-4 GY6.35 projection lamps, DFN/DFC/DCH/DJA/DFP incandescent projection lamps, DLD/DFZ GX17q incandescent projection lamps, DM G17q incandescent projection lamps, DPT mog base incandescent projection lamps, lamp shape B (B8 cand, B10 can, B13 med), lamp shape C (C7 cand, C7 DC bay), lamp shape CA (CA8 cand, CA9 med, CA10 cand, CA10 med), lamp shape G (G16.5 cand, G16.5 DC bay, G16.5 SC bay, G16.5 med, G25 med, G30 med, G30 med slut, G40 med, G40 mog) T6.5 DC bay, T8 disc (a single light engine module could be placed in one end, or a pair could be positioned one in each end), T6.5 inter, T8 med, lamp shape T (T4 cand, T4.5 cand, T6 cand, T6.5 DC bay, T7 cand, T7 DC bay, T7 inter, T8 cand, T8 DC bay, T8 inter, T8SC bay, T8 SC Pf, T10 med, T10 med Pf, T12 3C med, T14 med Pf, T20 mog bipost, T20 med bipost, T24 med bipost), lamp shape M (M14 med), lamp shape ER (ER30 med, ER39 med), lamp shape BR (BR30 med, BR40 med), lamp shape R (R14 SC bay, R14 inter, R20 med, R25 med, R30 med, R40 med, R40 med skrt, R40 mog, R52 mog), lamp shape P (P25 3C mog), lamp shape PS (PS25 3C mog, PS25 med, PS30 med, PS30 mog, PS35 mog, PS40 mog, PS40 mog Pf, PS52 mog), lamp shape PAR (PAR 20 med NP, PAR 30 med NP, PAR 36 scrw trim, PAR 38 skrt, PAR 38 med skrt, PAR38 med sid pr, PAR46 scrw trm, PAR46 mog end pr, PAR46 med sid pr, PAR56 scrw PAR56 mog end pr, PAR56 mog end pr, PAR64 scrw trm, PAR64 ex mog end pr). (see https://www.gecatalogs.com/lighting/software/GE-LightingCatalogSetup.exe) (with respect to each of the form factors, a light engine module can be positioned in any suitable location, e.g., with its axis coaxial with an axis of the form factor and in any suitable location relative to the respective electrical connector). The lamps according to the present inventive subject matter can satisfy (or not satisfy) any or all of the other characteristics for PAR lamps or for any other type of lamp.

Lighting devices in accordance with the present inventive subject matter can be designed to emit light in any suitable pattern, e.g., in the form of a flood light, a spotlight, a downlight, etc. Lighting devices according to the present inventive subject matter can comprise one or more light sources that emit light in any suitable pattern, or one or more light sources that emit light in each of a plurality of different patterns.

In many situations, the lifetime of light emitters can be correlated to a thermal equilibrium temperature (e.g., junction temperatures of solid state light emitters). The correlation between lifetime and junction temperature may differ based on the manufacturer (e.g., in the case of solid state light emitters, Cree, Inc., Philips-Lumileds, Nichia, etc). The lifetimes are typically rated as thousands of hours at a particular temperature (junction temperature in the case of solid state light emitters). Thus, in particular embodiments, the component or components of the thermal management system of the lighting device (or lighting device element) is/are selected so as to extract heat from the light emitters) and dissipate the extracted heat to a surrounding environment at such a rate that a temperature is maintained at or below a particular temperature (e.g., to maintain a junction temperature of a solid state light emitter at or below a 25,000 hour rated lifetime junction temperature for the solid state light source in a 25° C. surrounding environment, in some embodiments, at or below a 35,000 hour rated lifetime junction temperature, in further embodiments, at or below a 50,000 hour rated lifetime junction temperature, or other hour values, or in other embodiments, analogous hour ratings where the surrounding temperature is 35° C. (or any other value).

Solid state light emitter lighting systems can offer a long operational lifetime relative to conventional incandescent and fluorescent bulbs. LED lighting system lifetime is typically measured by an "L70 lifetime", i.e., a number of operational hours in which the light output of the LED lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein.

Various embodiments can be described with reference to "expected L70 lifetime." Because the lifetimes of solid state lighting products are measured in the tens of thousands of hours, it is generally impractical to perform full term testing to measure the lifetime of the product. Therefore, projections of lifetime from test data on the system and/or light source are used to project the lifetime of the system. Such testing methods include, but are not limited to, the lifetime projections found in the ENERGY STAR Program Requirements cited above or described by the ASSIST method of lifetime prediction, as described in "*ASSIST Recommends . . . LED Life For General Lighting: Definition of Life*", Volume 1, Issue 1, February 2005, the disclosure of which is hereby incorporated herein by reference as if set forth fully herein. Accordingly, the term "expected L70 lifetime" refers to the predicted L70 lifetime of a product as evidenced, for example, by the L70 lifetime projections of ENERGY STAR, ASSIST and/or a manufacturer's claims of lifetime.

Lighting devices according to some embodiments of the present inventive subject matter provide an expected L70 lifetime of at least 25,000 hours. Lighting devices according to some embodiments of the present inventive subject matter provide expected L70 lifetimes of at least 35,000 hours, and lighting devices according to some embodiments of the present inventive subject matter provide expected L70 lifetimes of at least 50,000 hours.

In some aspects of the present inventive subject matter, there are provided lighting devices that provide good efficiency and that are within the size and shape constraints of the lamp for which the lighting device is a replacement. In some embodiments of this type, there are provided lighting devices that provide lumen output of at least 600 lumens, and in some embodiments at least 750 lumens, at least 900 lumens, at least 1000 lumens, at least 1100 lumens, at least 1200 lumens, at least 1300 lumens, at least 1400 lumens, at least 1500 lumens, at least 1600 lumens, at least 1700 lumens, at least 1800 lumens (or in some cases at least even higher lumen outputs), and/or CRI Ra of at least 70, and in some embodiments at least 80, at least 85, at least 90 or at least 95).

In some aspects of the present inventive subject matter, which can include or not include any of the features described elsewhere herein, there are provided lighting devices that provide sufficient lumen output (to be useful as a replacement for a conventional lamp), that provide good efficiency and that are within the size and shape constraints of the lamp for which the lighting device is a replacement. In some cases, "sufficient lumen output" means at least 75% of the lumen output of the lamp for which the lighting device is a replacement, and in some cases, at least 85%, 90%, 95%, 100%, 105%, 110%, 115%, 120% or 125% of the lumen output of the lamp for which the lighting device is a replacement.

The lighting devices (or lighting device element) according to the present inventive subject matter can direct light in any desired range of directions. For instance, in some embodiments, the lighting device (or lighting device element) can direct light substantially omnidirectionally (i.e., substantially 100% of all directions extending from a center of the lighting device), i.e., within a volume defined by a two-dimensional shape in an x, y plane that encompasses rays extending from 0 degrees to 180 degrees relative to the y axis (i.e., 0 degrees extending from the origin along the positive y axis, 180 degrees extending from the origin along the negative y axis), the two-dimensional shape being rotated 360 degrees about the y axis (in some cases, the y axis can be a vertical axis of the lighting device). In some embodiments, the lighting device (or lighting device element) emits light substantially in all directions within a volume defined by a two-dimensional shape in an x, y plane that encompasses rays extending from 0 degrees to 150 degrees relative to the y axis (extending along a vertical axis of the lighting device), the two-dimensional shape being rotated 360 degrees about the y axis. In some embodiments, the lighting device (or lighting device element) emits light substantially in all directions within a volume defined by a two-dimensional shape in an x, y plane that encompasses rays extending from 0 degrees to 120 degrees relative to the y axis (extending along a vertical axis of the lighting device), the two-dimensional shape being rotated 360 degrees about the y axis. In some embodiments, the lighting device (or lighting device element) emits light substantially in all directions within a volume defined by a two-dimensional shape in an x, y plane that encompasses rays extending from 0 degrees to 90 degrees relative to the y axis (extending along a vertical axis of the lighting device), the two-dimensional shape being rotated 360 degrees about the y axis (i.e., a hemispherical region). In some embodiments, the two-dimensional shape can instead encompass rays extending from an angle in the range of from 0 to 30 degrees (or from 30 degrees to 60 degrees, or from 60 degrees to 90 degrees) to an angle in the range of from 90 to 120 degrees (or from 120 degrees to 150 degrees, or from 150 degrees to 180 degrees). In some embodiments, the range of directions in which the lighting device (or lighting device element) emits light can be non-symmetrical about any axis, i.e., different embodiments can have any suitable range of directions of light emission, which can be continuous or discontinuous (e.g., regions of ranges of emissions can be surrounded by regions of ranges in which light is not emitted). In some embodiments, the lighting device (or lighting device element) can emit light in at least 50% of all directions extending from a center of the lighting device (or lighting device element) (e.g., hemispherical being 50%), and in some embodiments at least 60%, 70%, 80%, 90% or more.

EXAMPLE 1

A lighting device is constructed that has 9 BSY LEDs and 3 LWBSW LEDs, along with one or more red and/or orange LED.

Each of the BSY LEDs emits light having x, y coordinates (1931 CIE Chromaticity Diagram) of 0.3545, 0.4053 (which correspond to u', v' coordinates (1976 CIE Chromaticity Diagram) of 0.1982, 0.5098), a dominant wavelength of 566 nm, a peak wavelength (i.e., wavelength of the blue/cyan/green LED excitation emitter) of 444 nm, a correlated color temperature of 4869 and a FWHM of 126.

Each of the LWBSY LEDs emits light having x, y coordinates of 0.3358, 0.4092 (which correspond to u', v' coordinates of 0.1856, 0.5088), a dominant wavelength of 556 nm, a peak wavelength (i.e., wavelength of the blue/cyan/green LED excitation emitter) of 472 nm, a correlated color temperature of 5414 and a FWHM of 113.

The red and/or orange LED(s) emits light having x, y coordinates of 0.6865, 0.3110 (which correspond to u', v' coordinates of 0.5143, 0.5227), a dominant wavelength of 619 nm, a peak wavelength of 627 nm and a FWHM of 16.

Energy is supplied to the lighting device and the lighting device emits light that has a CRI Ra of 94, and that includes 202.11 lumens (14.6 lumen %) from the red and/or orange LED(s), 876.84 (63.4 lumen %) from the BSY LEDs and 303.51 lumens (22.0 lumen %) from the LWBSY LEDs.

EXAMPLE 2

A lighting device is constructed that has two strings that each include six BSY LEDs, along with a third string that includes one or more red and/or orange LED.

Each of the BSY LEDs emits light having u', v' coordinates of 0.2362, 0.5121), a peak wavelength (i.e., wavelength of the blue/cyan/green LED excitation emitter) of about 450 nm, and a correlated color temperature of 3471.

Energy is supplied to the lighting device and the lighting device emits light that has a CRI Ra of 87.2.

One of the BSY LEDs in each of the BSY LED strings is then replaced with a LW BSY LED. Each of the LWBSY LEDs emits light having u', v' coordinates of 0.2358, 0.5112), a peak wavelength (i.e., wavelength of the blue/cyan/green LED excitation emitter) of 470 nm, and a correlated color temperature of 3468.

Energy is supplied to the lighting device and the lighting device emits light that has a CRI Ra of 93.7, and that includes about 14 lumen % from the red and/or orange LED(s), about 64 lumen % from the BSY LEDs and about 22 lumen % from the LWBSY LEDs.

Any two or more structural parts of the devices described herein can be integrated. Any structural part of the devices described herein can be provided in two or more parts, which are held together, if necessary.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A lighting device comprising:

a first group of non-white light sources, the non-white light sources, when illuminated, emitting light having u', v' color coordinates which define a point which is (1) outside a first area on a 1976 CIE Chromaticity Diagram which is bounded by a first white-light boundary curve which is 0.01 u'v' above the planckian blackbody locus and a second white-light boundary curve which is 0.01 u'v' below the planckian blackbody locus, and line segments connecting respective left and right ends of the first white-light boundary curve and of the second white-light boundary curve, and (2) within a second area on a 1976 CIE Chromaticity Diagram which is enclosed by a first saturated light curve extending along all points representing saturated light having wavelength in the range of from about 390 nm to about 500 nm, a line segment extending from a point representing saturated light having wavelength of about 500 nm to a point representing saturated light having wavelength of about 560 nm, a second saturated light curve extending along all points representing saturated light having wavelength in the range of from about 560 nm to about 580 nm, and a line segment extending from a point representing saturated light having wavelength of about 580 nm to a point representing saturated light having wavelength of about 390 nm; and at least one supplemental light emitter having a dominant emission wavelength in the range of from about 600 nm to about 640 nm, the first group of non-white light sources comprising (1) at least a first phosphor converted solid state light emitter that comprises a first excitation source that emits light having a first dominant wavelength, and (2) at least a second phosphor converted solid state light emitter that comprises a second excitation source that emits light having a second dominant wavelength, the first dominant wavelength differing from the second dominant wavelength by at least 5 nm.

2. A lighting device as recited in claim 1, wherein when the first group of non-white light sources and the at least one supplemental light emitters are emitting light, a mixture of (1) light emitted from the lighting device which was emitted by the first group of non-white light sources, and (2) light emitted from the lighting device which was emitted by the at least one supplemental light emitter would, in the absence of any additional light, have a combined illumination having x, y color coordinates which is within 0.01 u'v' of at least one point on the blackbody locus on a 1976 CIE Chromaticity Diagram.

3. A lighting device as recited in claim 1, wherein the lighting device further comprises at least a first power line, and when energy is supplied to the first power line, the lighting device emits light which is within 0.01 u'v' of at least one point on the blackbody locus on a 1976 CIE Chromaticity Diagram.

4. A lighting device as recited in claim 1, wherein when the first group of non-white light sources and the at least one supplemental light emitter are emitting light, light emitted from the lighting device which was emitted by non-white light sources that emit light having a dominant wavelength in the range of from about 430 nm to about 480 nm comprises from about 40 percent to about 95 percent of the light emitted from the lighting device.

5. A lighting device as recited in claim 1, wherein the first group of non-white light sources comprises at least one solid state light emitter that has a peak emission wavelength in the range of from about 390 nm to about 480 nm.

6. A lighting device as recited in claim 1, wherein the first group of non-white light sources comprises at least a first luminescent material that has a dominant emission wavelength in the range of from about 560 nm to about 580 nm.

7. A lighting device as recited in claim 1, wherein at least one of the non-white light sources in the first group of non-white light sources, when illuminated, emits light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a :fourth the fourth line segment connecting the fourth point to a filth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

8. A lighting device as recited in claim 1, wherein when the first group of non-white light sources and the at least one supplemental light emitter are emitting light, a mixture of (1) light emitted from the lighting device which was emitted by the first group of non-white light sources, and (2) light emitted from the lighting device which was emitted by the at least one supplemental light emitter would, in the absence of any additional light, have a correlated color temperature in the range of from about 2,000 K to about 11,000 K.

9. A lighting device as recited in claim 1, wherein when the first group of non-white light sources and the at least one supplemental light emitter are emitting light, a mixture of (1) light emitted from the lighting device which was emitted by the first group of non-white light sources, and (2) light emitted from the lighting device which was emitted by the at least one supplemental light emitter would, in the absence of any additional light, have a CRI of at least Ra 85.

10. A lighting device, comprising:

a first group of non-white light sources, the non-white light sources, when illuminated, emitting light having u', v' color coordinates which define a point which is (1) outside a first area on a 1976 CIE Chromaticity Diagram which is bounded by a first white-light boundary curve which is 0.01 u'v' above the planckian blackbody locus and a second white-light boundary curve which is 0.01 u'v' below the planckian blackbody locus and (2) within a second area on a 1976 CIE Chromaticity Diagram which is enclosed by a first saturated light curve extending along all points representing saturated light having wavelength in the range of from about 390 nm to about 500 nm, a line segment extending from a point representing saturated light having wavelength of about 500 nm to a point representing saturated light having wavelength of about 560 nm, a second saturated light curve extending along all points representing saturated light having wavelength in the range of from about 560 nm to about 580 nm, and a line segment extending from a point representing saturated light having wavelength of about 580 nm to a point representing saturated light having wavelength of about 390 nm;

at least one supplemental light emitter having a dominant emission wavelength in the range of from about 600 nm to about 640 nm, and means for generating light which mixes with light emitted by the first group of non-white light sources and light emitted by the at least one supplemental light emitter to produce mixed light that has a color point which is within 0.01 u'v' of at least one point on the blackbody locus on a 1976 CIE Chromaticity Diagram, the first group of non-white light sources comprising (1) at least a first phosphor converted solid state light emitter that comprises a first excitation source that emits light having a first dominant wavelength, and (2) at least a second phosphor converted solid state light emitter that comprises a second excitation source that emits light having a second dominant wavelength, the first dominant wavelength differing from the second dominant wavelength by at least 5 nm.

11. A lighting device as recited in claim 10, wherein:

the first excitation source comprises a light emitting diode having a dominant wavelength in the range of from about 430 nm to about 480 nm; and the second excitation sources comprises a light emitting diode having a dominant wavelength in the range of from about 450 nm to about 500 nm.

12. A method of lighting, comprising:

supplying electricity to a first group of non-white light sources to cause the first group of non-white light sources to emit light having u', v' color coordinates which define a point which is (1) outside a first area on a 1976 CIE Chromaticity Diagram which is bounded by a first white-light boundary curve which is 0.01 u'v' above the planckian blackbody locus and a second white-light boundary curve which is 0.01 u'v' below the planckian blackbody locus and (2) within a second area on a 1976 CIE Chromaticity Diagram which is enclosed by a first saturated light curve extending along all points representing saturated light having wavelength in the range of from about 390 nm to about 500 rim, a line segment extending from a point representing saturated light having wavelength of about 500 nm to a point representing saturated light having wavelength of about 560 nm, a second saturated light curve extending along all points representing saturated light having wavelength in the range of from about 560 nm to about 580 nm, and a line segment extending from a point representing saturated light having wavelength of about 580 nm to a point representing saturated light having wavelength of about 390 nm; and supplying electricity to at least one supplemental light emitter to cause the at least one supplemental light emitter emit light having a dominant emission wavelength in the range of from about 600 nm to about 640 nm, the first group of non-white light sources comprising (1) at least a first phosphor converted solid state light emitter that comprises a first excitation source that emits light having a first dominant wavelength, and (2) at least a second phosphor converted solid state light emitter that comprises a second excitation source that emits light having a second dominant wavelength, the first dominant wavelength differing from the second dominant wavelength by at least 5 nm.

13. A method as recited in claim 12, wherein the first excitation source comprises a light emitting diode having a dominant wavelength in the range of from about 430 nm to about 480 nm and the second excitation source comprises a light emitting diode having a dominant wavelength in the range of from about 450 nm to about 500 nm.

14. A method as recited in claim 12, wherein:

a mixture of (1) light emitted from the lighting device which was emitted by the first group of non-white light sources, and (2) light emitted from the lighting device which was emitted by the at least one supplemental light emitter has, in the absence of any additional light, a combined illumination having x, y color coordinates which is within 0.01 u'v' of at least one point on the blackbody locus on a 1976 CIE Chromaticity Diagram.

15. A lighting device comprising:

a first group of non-white light sources, the non-white light sources, when illuminated, emitting light having u', v' color coordinates which define a point which is (1) outside a first area on a 1976 CIE Chromaticity Diagram which is bounded by a first white-light boundary curve which is 0.01 u'v' above the planckian blackbody locus and a second white-light boundary curve which is 0.01 u'v' below the planckian blackbody locus, and line segments connecting respective left and right ends of the first white-light boundary curve and of the second white-light boundary curve, and (2) within a second area on a 1976 CIE Chromaticity Diagram which is enclosed by a first saturated light curve extending along all points representing saturated light having wavelength in the range of from about 390 nm to about 500 nm, a line segment extending from a point representing saturated light having wavelength of about 500 nm to a point representing saturated light having wavelength of about 560 nm, a second saturated light curve extending along all points representing saturated light having wavelength in the range of from about 560 nm to about 580 nm, and a line segment extending from a point representing saturated light having wavelength of about 580 nm to a point representing saturated light having wavelength of about 390 nm; and at least one supplemental light emitter having a dominant emission wavelength in the range of from about 600 nm to about 640 nm, the first group of non-white light sources comprising (1) at least a first phosphor light emitting diode comprising a light emitting diode having a dominant wavelength in the range of from about 430 nm to about 480 nm; and (2) at least a second phosphor light emitting diode comprising a light emitting diode having a dominant wavelength in the range of from about 450 nm to about 500 nm.

16. A lighting device comprising:

a first group of non-white light sources, the non-white light sources, when illuminated, emitting light having u', v' color coordinates which define a point which is (1) outside a first area on a 1976 CIE Chromaticity Diagram which is bounded by a first white-light boundary curve which is 0.01 u'v' above the planckian blackbody locus and a second white-light boundary curve which is 0.01 u'v' below the planckian blackbody locus, and line segments connecting respective left and right ends of the first white-light boundary curve and of the second white-light boundary curve, and (2) within a second area on a 1976 CIE Chromaticity Diagram which is enclosed by a first saturated light curve extending along all points representing saturated light having wavelength in the range of from about 390 nm to about 500 nm, a line segment extending from a point representing saturated light having wavelength of about 500 nm to a point representing saturated light having wavelength of about 560 nm, a second saturated light curve extending along all points representing saturated light having wavelength in the range of from about 560 nm to about 580 nm, and a line segment extending from a point representing saturated light having wavelength of about 580 nm to a point representing saturated light having wavelength of about 390 nm; and at least one supplemental light emitter having a dominant emission wavelength in the range of from about 600 nm to about 640 nm, the first group of non-white light sources comprising at least a first sub-group of non-white light sources and a second sub-group of non-white light sources, the first sub-group of non-white light sources, when illuminated, emitting light having u', v' color coordinates which define a point which is (1) outside the first area, and (2) within the second area;

the second sub-group of non-white light sources, when illuminated, emitting light having u', v' color coordinates which define a point which is (1) outside the first area, and (2) within the second area;

the first sub-group comprising at least a first excitation source that emits light having a first dominant wavelength, the second sub-group comprising a single illuminator having a second dominant wavelength, the first dominant wavelength differing from the second dominant wavelength by at least 5 nm.

17. A lighting device as recited in claim 16, wherein:

the first group of non-white light sources further comprises a third sub-group of non-white light sources, the third sub-group of non-white light sources, when illuminated, emits light having u', v' color coordinates which define a point which is (1) outside the first area, and (2) within the second area;

the first sub-group of non-white light sources is electrically connected so as to be commonly energized;

the third sub-group of non-white light sources is electrically connected so as to be commonly energized and separately energized from the first sub-group of non-white light sources; and at least one of the second sub-group of non-white light sources is electrically connected so as to be commonly energized with the first sub-group of non-white light emitters.

18. A lighting device as recited in claim 17, wherein at least one of the second sub-group of non-white light sources is electrically connected so as to be commonly energized with the third sub-group of non-white light emitters.

19. A lighting device as recited in claim 16, wherein an excitation emitter of at least one light source of the second sub-group of non-white light sources has a dominant wavelength in the range of from about 475 nm to about 485 nm.

20. A lighting device as recited in claim 16 wherein:

the first sub-group of non-white light sources is on a first string;

the second sub-group of non-white light sources is on a second string; and the at least one supplemental light emitter is on a third string.

21. A lighting device as recited in claim 16 wherein:

the first sub-group of non-white light sources comprises at least one phosphor converted solid state light emitter that comprises a first excitation source that emits light having a first dominant wavelength, the second sub-group of non-white light sources comprises at least one phosphor converted solid state light emitter that comprises a second excitation source that emits light having a second dominant wavelength, and the first dominant wavelength differs from the second dominant wavelength by at least 5 nm.

22. A lighting device as recited in claim 16, wherein:

the first sub-group of non-white light sources emits light which is more blueish than light emitted by the second sub-group of non-white light sources, and the second sub-group of non-white light sources emits light which is more yellowish than light emitted by the first sub-group of non-white light sources.

23. A lighting device as recited in claim 16, wherein the first sub-group of non-white light sources and the second sub-group of non-white light sources each comprise at least one light source having a FWHM value of at least 40 nm.

* * * * *

UNITED STATES PATENT AND TRADEMARK OFFICE

CERTIFICATE OF CORRECTION

PATENT NO. : 8,896,197 B2
APPLICATION NO. : 13/104469
DATED : November 25, 2014
INVENTOR(S) : Gerald H. Negley and Antony Paul Van De Ven It is certified that error appears in the above-identified patent and that said Letters Patent is hereby corrected as shown below:

In the Specification

Column 34, Line 10

Please change: "No. 2011/0182065), entitled "LIGHTING DEVICE WITII" to -- No. 2011/0182065), entitled "LIGHTING DEVICE WITH --

In the Claims

Column 53, Lines 39 to 40

Please change: "line segment connecting the third point to a :fourth the fourth line segment connecting the fourth point to a filth point, and" to -- line segment connecting the third point to a fourth point, the fourth line segment connecting the fourth point to a fifth point, and --

Column 54, Line 60

Please change: "from about 390 nm to about 500 rim, a line segment" to -- from about 390 nm to about 500 nm, a line segment --

Signed and Sealed this
Fifth Day of May, 2015

Michelle K. Lee

Michelle K. Lee
*Director of the United States Patent and Trademark Office*